US007260945B2

(12) United States Patent
Landry

(10) Patent No.: US 7,260,945 B2
(45) Date of Patent: Aug. 28, 2007

(54) DESICCANT-ASSISTED AIR CONDITIONING SYSTEM AND PROCESS

(75) Inventor: Gerald Landry, Katy, TX (US)

(73) Assignee: Allanco Technologies, Inc., Katy, TX (US)

( * ) Notice: Subject to any disclaimer, the term of this patent is extended or adjusted under 35 U.S.C. 154(b) by 4 days.

(21) Appl. No.: 11/135,066

(22) Filed: May 22, 2005

(65) Prior Publication Data

US 2005/0257551 A1 Nov. 24, 2005

Related U.S. Application Data

(60) Provisional application No. 60/592,879, filed on Jul. 30, 2004, provisional application No. 60/588,409, filed on Jul. 16, 2004, provisional application No. 60/573,086, filed on May 22, 2004.

(51) Int. Cl.
*F25D 17/06* (2006.01)
*F25D 23/00* (2006.01)
*F25D 17/00* (2006.01)

(52) U.S. Cl. ..... 62/94; 62/271; 62/232

(58) Field of Classification Search ..... 62/94, 62/232, 271

See application file for complete search history.

(56) References Cited

U.S. PATENT DOCUMENTS

2002/0116935 A1* 8/2002 Forkosh et al. ..... 62/93
2004/0060315 A1* 4/2004 Dinnage et al. ..... 62/271

* cited by examiner

*Primary Examiner*—Cheryl Tyler
*Assistant Examiner*—B. Clayton McCraw
(74) *Attorney, Agent, or Firm*—Kenneth A. Roddy

(57) ABSTRACT

A desiccant-assisted air conditioning system utilizes a compressor (10), a condenser coil (11), an evaporator coil (13), supplemental desiccant coils (19, 20) connected therewith, and damper (18A, 19B) and valve arrangements that direct air and refrigerant through the system coils in several different thermodynamic operating paths. The system combines, transfers and reverses thermodynamic energies between the desiccant, the refrigerant and the crossing air, and simultaneously maximizes the refrigerant vapor compression closed cycle and desiccant vapor compression open cycle. The desiccant coils (19, 20) not only provide an effective gas phase change in their crossing air streams, but also simultaneously provide endothermic and exothermic energy exchanges between the air streams and the passing refrigerant that maximize the operating efficiency of the compressor, condenser coil, and evaporator coil, conserves energy, and produces quality conditioned air output.

28 Claims, 11 Drawing Sheets

DESICCANT-ASSISTED AIR CONDITIONING SYSTEM AND PROCESS

CROSS REFERENCE TO RELATED APPLICATIONS

This application claims priority of U.S. Provisional Application Ser. No. 60/573,086, filed May 22, 2004, U.S. Provisional Application Ser. No. 60/588,409, filed Jul. 16, 2004, and U.S. Provisional Application Ser. No. 60/592,879, filed Jul. 30, 2004.

BACKGROUND OF THE INVENTION

1. Field of the Invention

This invention relates generally to desiccant-assisted air conditioning systems and processes, and more particularly to an air conditioning system utilizing a compressor, a condenser coil, an evaporator coil, supplemental desiccant coils, and damper and valve arrangements that direct air and refrigerant through the system in several different thermodynamic operating paths and cycles for significantly improved efficiency and energy conservation.

2. Background Art

The control of humidity in indoor environments plays a very important role in providing indoor air quality. Reducing the volume of moisture indoors can reduce the growth of microbiological organisms such as mold, mildew and bacteria, which require moisture to thrive. Airborne contaminants are also often carried with the moisture in the supplied air streams. Most conventional air conditioning processes and systems do not effectively control humidity, nor provide adequate delivery air conditions, in anticipation of the various changes and demands of the indoor or outdoor environments. Although conventional systems provide dehumidification, it is an uncontrolled byproduct of its evaporator coil cooling process, and results in the inadequate control of humidity, and excessive energy consumption, and can also result in building and or space content damage.

In the refrigerant compression closed cycle of the conventional air conditioning system, a compressor compresses refrigerant gas to increases its pressure and temperature, in an isentropic adiabatic process. The refrigerant is then passed through a condenser coil where the superheated compressed refrigerant dissipates its heat to the crossing air stream condensing the refrigerant into a high-pressure liquid, which then flows through a metering device or expansion valve that restricts the high-pressure liquid and creates a reverse refrigerant adiabatic effect, after which, the refrigerant is discharged or suctioned to an evaporator coil at lower refrigerant temperature and pressure conditions, which enable the evaporator coil to absorb heat from the crossing air that is forced through the coil by the evaporator fan. The air exiting the evaporator coil is discharged as cool air and the refrigerant absorption process changes the refrigerant from liquid-gas to gas, which is then suctioned back to the compressor to complete the closed cycle. Increasing the refrigerant conditions of the evaporator, or lowering the condensing refrigerant temperature and pressure improves the compressor and system performance and energy consumption.

In the air cooling process, the conventional finned evaporator coil provides dehumidification only if the saturated vapor conditions are achieved in its crossing air, and additional cooling is typically necessary to augment moisture removal. This accomplished by lowering the refrigerant pressure and temperature by increasing the compressor capacity or lowering the crossing air stream volume in the evaporator. Efficient heat transfer of a coil is dependent upon the temperature differential between the refrigerant temperature relative to the temperature of the crossing air. The accumulation of water on the evaporator fins serves as an excellent conductor for transferring heat energy to its crossing air stream. The temperature of the water on the fins tends to become lower quickly, because of its direct conductive energy exchange, and at lower temperatures it consequently crystallizes and freezes; it becomes an insulator and diminishes energy transfer capabilities and effectiveness. The ice build can also restrict the air path and further diminish the conductive thermal energy transfer capabilities and efficiencies of the refrigerant.

Thus, if frost becomes a problem, the system requires sequencing to a defrost mode, which stops the refrigeration cooling effects. Added heat energy is often required to accelerate the ice melting effect, or depending upon the temperature of the crossing air, the air itself may be utilized to defrost the accumulated ice. Defrosting or non-continuous cooling can adversely affect the air quality and/or comfort level in the conditioned space. Additional cooling is needed to compensate for any added heat provided by the defrost process and circumstances.

A conventional heat pump also utilizes finned coils and operates on the same principle as an air conditioning system, except that it provides a reversing valve and other controls that reverse the refrigerant flow between the evaporator and condenser coil so that outdoor heat exchanger coil becomes the evaporator and the indoor coil becomes the condenser. This enables the suctioned refrigerant to absorb the remaining heat from the outdoor air and the compressed refrigerant to dissipate its heat at the indoor coil which then heats the conditioned space through its crossing air stream. In the heating mode, the refrigerant cooling cycle takes place through the outdoor coil. At low outdoor temperatures, frost tends to build on the finned coil and lessens the system efficiencies, as previously described; a defrosting mode to remove the frost build up becomes necessary, which is accomplished by re-reversing the refrigerant flow.

Desiccant assisted air conditioning systems are also known in the art, which typically incorporate a rotating desiccant wheel that rotates between two air streams to provide dehumidification or humidification by alternating the energy in a gas phase change process. In such systems, the air (process air) delivered to the interior of a space to be conditioned space crosses the desiccant material, which attracts and holds moisture. As the desiccant wheel rotates, the moist desiccant material enters the regeneration air stream where it is heated to release moisture, which is then vented away. Because humidity is a function of vapor pressure, desiccant materials have the ability to remove or add moisture adiabatically; a reversible thermodynamic process in which the energy exchanges result in substantially constant enthalpy equilibrium. The total desiccant open cycle is somewhat similar to a refrigerant vapor-compression cycle. In a desiccant and air system the heated regeneration air adds energy to the moistened desiccant in a de-sorption process and releases moisture in the regenerating crossing air stream in an adiabatic cooling process. When the desiccant rotates to the process air stream the pre-conditioned desiccant enables the sorption of water and dehumidifies the crossing process air. Adiabatic re-heat then is released in the air stream and completes the desiccant vapor-compression open cycle.

Mathiprakasam, U.S. Pat. No. 4,430,864 discloses a hybrid vapor compression and desiccant air conditioning system utilizing an air thermodynamic cycle for simultaneous removal of the sensible and latent heats from the room return air. The system employs a pair of heat exchangers having a desiccant material thereon, which replace the conventional condenser and evaporator. The refrigerant, room and outside ambient air flows are selectively routed to the heat exchangers to allow one heat exchanger to operate as an evaporator to effect cooling and drying of the room return air while the other heat exchanger acts as a condenser of the refrigerant and regenerates the desiccant material thereon. The heat exchangers are switchable between evaporator and condenser modes allowing for continuous conditioning of the room return air.

The desiccant coils in U.S. Pat. No. 4,430,864, provide a somewhat effective conductive energy transfer to occur, but the desiccant serves primarily to accumulate water. The process re-uses the condensing energy to regenerate its desiccant, which slightly benefits the refrigeration cycle and performance by allowing refrigeration absorption to accelerate and augment some dehumidification in the crossing process air of the desiccant coil. However, the transferable energy provided by the desiccant upon switching is far from being maximized. The pre-wetted desiccant coil upon switching provides a total cooling effect, but most of its interchangeable energy merely replaces what a conventional condenser can already do effectively. Very little refrigerant adiabatic cooling effect is added to augment the compressor performance. The same is true in the process air stream. The pre-dried desiccant merely replaces what a conventional evaporator coil can already do effectively, and is still dependent upon high refrigerant temperature and pressure conditions for the removal of sensible and latent energy in its air stream. The amount of absorbed refrigerant energy from the pre-dried desiccant and crossing air is the direct result of the total average coil temperature and vapor-pressure conditions of its desiccant and crossing air. The total coil average temperature and the average regeneration refrigerant energy transferred to the desiccant is definitely not maximized and the pre-dried desiccant condition elevates very little in proportion to the total average refrigerant conditions and results in a less effective refrigerant adiabatic cooling effect in the refrigeration cycle to augment the compressor efficiency. In the coil switching process, the inefficient total coil average temperature can produce a situation where the regenerated desiccant has insufficient dryness and acts as a heat sink in the process air stream, which results in reheating the crossing process air and wasted heat energy. A system with only two desiccant coils that replace the conventional evaporator and condenser is also disadvantageous in that it does not provide steady constant air delivery conditions when switching the coils.

Dinnage et al, U.S. Pat. Nos. 6,557,365, 6,622,508, 6,711,907, Published Patent Application 2004/0060315, and Published Patent Application 2005/0050906 disclose systems utilizing rotary desiccant wheels, and utilizing rejected condenser heat as energy to regenerate the desiccant. In general, the basic refrigeration system incorporates part of the condenser coil in the regeneration air stream prior to the desiccant wheel and the evaporator coil prior to the desiccant wheel, in the process air stream. The refrigerant energy is re-used to regenerate the desiccant and the evaporator provides refrigeration capacity and conditions the process air prior contacting the wheel. As with most desiccant wheel systems, this process has limitations in effective cooling. The regeneration entering air is low in temperature, and the vapor-pressure conditions are provided to the desiccant externally in a gas phase change process, rather than heating it directly by the internal refrigerant. Energy is also consumed by continuously rotating the desiccant wheel.

Forkosh et al, U.S. Pat. Nos. 6,487,872, 6,494,053, 6,546,746, Published Patent Application 2004/0112077, and Published Patent Application 2005/0211207 disclose dehumidification and air conditioning systems utilizing liquid desiccants. Dehumidifying systems based on liquid desiccants dehumidify air by passing the air through a tank filled with desiccant. The moist air enters the tank via a moist air inlet and dried air exits the tank via a dried air outlet. In most liquid desiccant systems, a shower of desiccant from a reservoir is sprayed into the tank and, as the desiccant droplets descend through the moist air, they absorb water from it. The desiccant is then returned to the reservoir for reuse. This causes an increase in the water content of the desiccant. Water saturated desiccant accumulates in the reservoir and is pumped therefrom to a regenerator unit where it is heated to drive off its absorbed water as vapor. Regenerated desiccant, which heats up in this process, is pumped back into the reservoir, for reuse. Since the water absorption process leads to heating of the air and the regeneration process heats the desiccant, substantial heating of the air takes place during the water absorption process.

SUMMARY OF THE INVENTION

The present invention overcomes the aforementioned problems and is distinguished over the prior art in general, and these patents in particular, by a desiccant-assisted air conditioning system and process which utilizes a compressor, a condenser coil, an evaporator coil, supplemental desiccant coils, and damper and valve arrangements that direct air and refrigerant through the system coils in several different thermodynamic operating paths and cycles for significantly improved operating efficiency, energy conservation, and conditioned air output. The system effectively combines, transfers and reverses thermodynamic energies between the desiccant, the refrigerant and the crossing air, and maximizes the refrigerant vapor compression closed cycle and desiccant vapor compression open cycle.

The present invention utilizes the conventional condenser and evaporator coils in combination with a pair of desiccant coils to increase total coil average temperature and refrigerant energy transfer capacity to the desiccant in regeneration. The system not only utilizes the desiccant coils to exchange energy externally in the crossing air gas phase, but also utilizes the desiccant coil properties to augment the refrigerant absorption and rejection energies, and utilizes the properties of the refrigerant to exchange internal heat energy with the desiccant coils to condition the desiccant more efficiently.

The normally rejected refrigerant energy is transferred from the conventional condenser coil to the first desiccant coil, thereby increasing its refrigeration pressure and temperature capacity. The concentrated refrigerant energy and increased capacity dissipates the concentrated heat through the desiccant material, thereby increasing the vapor-pressure differential of the desiccant in relation to its crossing air stream and vapor pressure conditions. The increased refrigerant energy regenerates the desiccant material to a dryer condition prior to the switching to a cross flow mode of operation. In this process, the adiabatic cooling effect of the second desiccant coil provided by the evaporation of the water content in its desiccant material to the passing air stream is not adversely affected because of the transferred increased concentrated refrigerant energy and capacity, which is transferred gradually. The sorption process and adiabatic heating effect of the second desiccant coil provides normally rejected work energy which is used in series with the refrigerant compressor to serve as a co-generator in the refrigeration cycle, and also provides simultaneous rapid cooling of the desiccant, accelerates dehumidification of its air stream with no appreciable sensible heat added to the air stream, and allows the accumulation of moisture prior to switching from a straight airflow mode to a cross airflow mode.

In a combined refrigerant closed cycle and desiccant open cycle, the refrigerant compression process occurs during the desiccant sorption process; the refrigerant condensing process occurs during the desiccant regeneration process; the refrigerant expansion process occurs during the desiccant de-sorption process; and the refrigeration evaporative process occurs during the desiccant expansion process. In a refrigerant closed cycle and desiccant switching cycle, the air and refrigerant paths are switched between the first and second desiccant coils so that two sets of processes occur at the same time. The desiccant de-sorption and regeneration process occurs at the same time as the refrigerant expansion and condensing process, and while the desiccant sorption and expansion process are also occurring at the same time as the refrigeration compression and evaporation process.

In the cross flow mode and desiccant switching cycle, when the second coil has a diminished capacity to attract moisture and after the first has sufficiently dried, the air and refrigerant paths are switched between the desiccant coils and the previously moistened second coil becomes the desiccant regeneration coil and the dried first coil becomes the process desiccant coil. Thus, their roles are reversed, and the states of their previous moisture conditions facilitates the desiccant sorption and de-sorption process.

BRIEF DESCRIPTION OF THE DRAWINGS

In the drawing figures of the present invention, described in detail hereinafter, the heavy line arrows represent the airflow path of air and the thinner lines represent the flow path of refrigerant.

DESCRIPTION OF THE PREFERRED EMBODIMENTS

Figure 1:
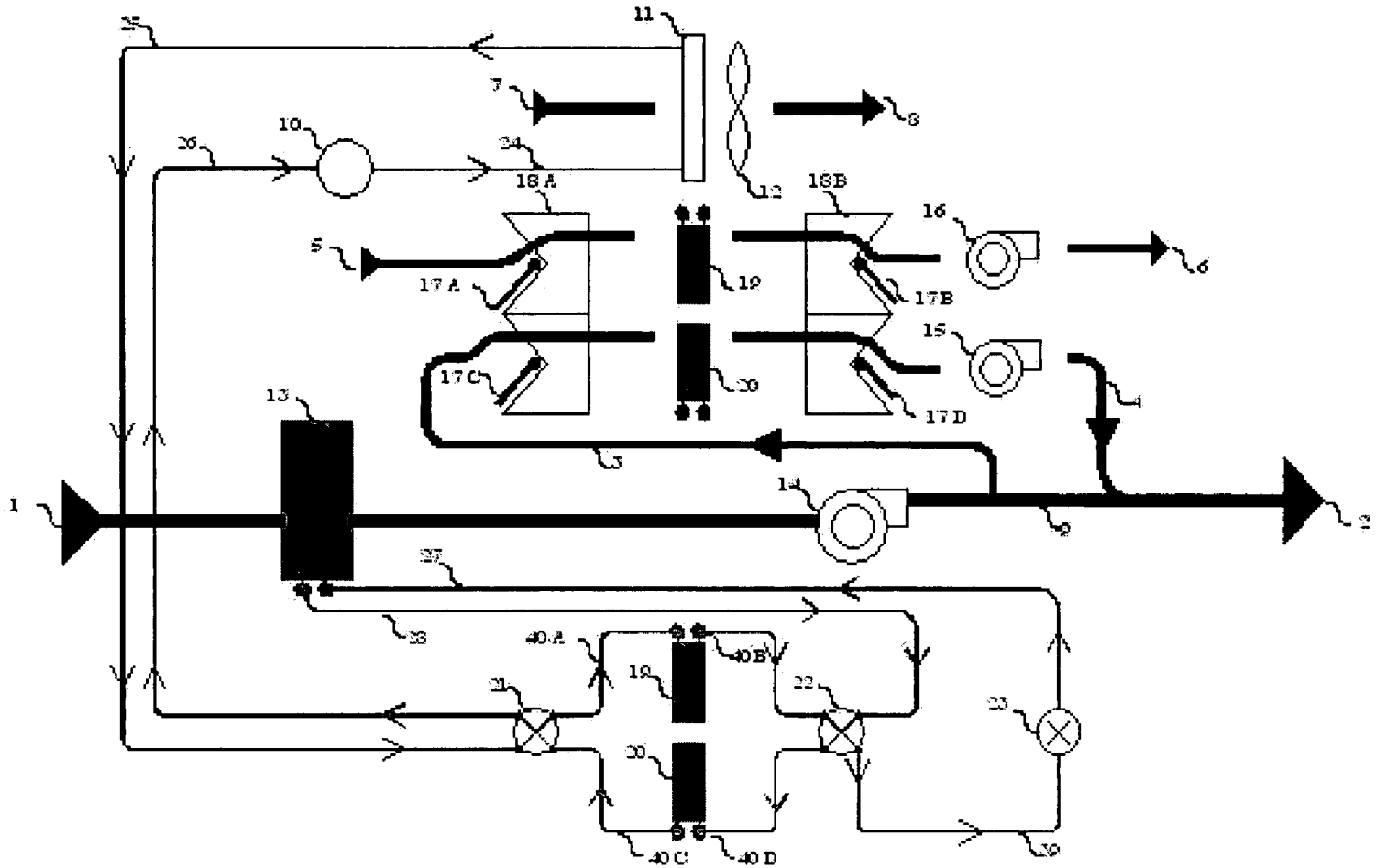
FIG. 1 is a diagrammatic view illustrating the components of the air conditioning system showing the airflow and refrigerant paths for routing the air and refrigerant through the coils in a straight flow cooling mode of operation.

As used herein, the term "air conditioning" is a general term and includes dehumidified air, humidified air, and cool or warm air, or a combination thereof. The term "process air" means any air that is to be processed by the present system. The term "regeneration air" means any air that is used to regenerate the desiccant material. The term "supply air" means the air that is supplied to a spaced to be provided with conditioned air. The term "return air" means the air either returning from the conditioned space or newly introduced air. The term "refrigerant" means a substance used as an agent for cooling or heating, and includes such substances in a liquid, gas, or vapor form. The term "desiccant" means a drying substance or agent and may include materials such as silicas, aluminas, titanium, lithium chloride, zeolites, polymers and clay. The term "compressor" means a machine for reducing the volume and increasing the pressure of gases in order to condense and expand the gases. The term "condenser" means a device for reducing gases or vapors to liquid form and includes air-cooled and water-cooled heat exchangers.

In the drawing figures of the present invention, described in detail hereinafter, the heavy line arrows represent the airflow path of air and the thinner lines represent the flow path of refrigerant. The outdoor portion of the system is shown at the top of the figure, the indoor portion is show at the center, and the refrigerant flow and valving arrangement for the desiccant coils is shown at the bottom.

Referring now to the drawings, there is shown diagrammatically in FIG. 1, the components of the present air conditioning system showing the airflow and refrigerant paths for routing the air and refrigerant through the coils in a straight flow cooling mode of operation.

The present apparatus includes a conventional compressor 10 connected by a refrigerant discharge line 24 to the intake of a condenser coil 11 having a condenser fan 12 that draws outdoor air 7 through the condenser coil and exhausts it back to the outdoors 8. A conventional evaporator coil 13 is connected with the compressor 10 and the condenser coil 11, through a piping and valving arrangement, as described in detail hereinafter. Process air 1 is drawn across the evaporator coil 13 by a process air blower or fan 14 and is discharged as supply air 9 either into the space to be conditioned 2, or a portion may be selectively conducted through a damper assembly 18A, 18B and across either of a pair of desiccant coils 19, 20, as described hereinafter.

In the present system, a first desiccant coil 19 and a second desiccant coil 20 are disposed between a first damper assembly 18A and a second damper assembly 18B. Desiccant regeneration air 5 is drawn by a regeneration air fan 16 through the damper assemblies 18A and 18B and exhausted as regeneration air exhaust 6 to the outdoors or other suitable area. A desiccant process air fan 15 draws a portion of the discharged supply air 9 from the evaporator coil 13 as desiccant process air 3 through the damper assemblies 18A and 18B and discharges it as desiccant process discharge air 4 back into the supply air 9 which is conducted into the space to be conditioned 2. The first and second damper assemblies 18A and 18B have movable dampers 17A, 17B, 17C, and 17D for selectively directing the passage of desiccant regeneration air 5 and desiccant process air 3 across either of the first or second desiccant coils 19 or 20.

As shown at the bottom of FIG. 1, the first desiccant coil 19 is connected in series with a first port of a first reversing valve 21 and a first port of a second reversing valve 22 by refrigerant lines 40A and 40 B. The second desiccant coil 20 is connected in series with a second port of the first reversing valve 21 and a second port of the second reversing valve 22 by refrigerant lines 40C and 40 D. The suction side of the compressor 10 is connected by a refrigerant line 26 to a third port of the first reversing valve 21, and the outlet of the condenser coil 11 is connected by a refrigerant line 25 to a fourth port of the first reversing valve 21.

The evaporator coil 13 is connected in series between a third port of the second reversing valve 22 by a refrigerant line 28 and a fourth port of the second reversing valve through refrigerant line 27, a metering device or expansion valve 23, and refrigerant line 39. The reversing valves 21, 22 can selectively redirect the refrigerant path, as described hereinafter.

STRAIGHT FLOW COOLING MODE

FIG. 1 shows the components of the present air conditioning system and the airflow and refrigerant paths for routing the air and refrigerant through the coils in a straight flow cooling mode of operation.

The compressor 10 discharges high pressure superheated refrigerant via line 24 through the condenser coil 11. The condenser fan 12 draws outdoor air 7 across the condenser coil 11, the refrigerant dissipates heat at the coil and condenses into a high-pressure liquid, and the heated air is exhausted back to the outdoors.

The cooled refrigerant from the condenser coil 11 flows through line 25 to the first reversing valve 21 which is positioned to direct the refrigerant via line 40A through the first desiccant coil 19, through line 40B to the second reversing valve 22 which is positioned to direct the refrigerant via line 39 through the metering device or expansion valve 23. It is important to note that, since the coils 11 and 19 are in series, the superheated refrigerant is first cooled by the condenser coil 111 before entering the desiccant coil 19. After passing through the metering device or expansion valve 23, the refrigerant flows via line 27 into the evaporator coil 13.

When the high-pressure cooled refrigerant passes through the metering device or expansion valve 23, it is restricted and it enters the evaporator coil 13 at a lower temperature and pressure. The refrigerant passing through the evaporator coil 13 absorbs heat from the process intake air 1 drawn across the coil by the process air fan 14 and air exiting the evaporator coil is discharged as cool air, at lower temperature and increased saturated vapor conditions. After passing through the evaporator coil 13, the refrigerant passes through refrigerant line 28, back through the second reversing valve 22, through line 40D, through the second desiccant coil 20, through line 40C to the first reversing valve 21, which is positioned to permit the refrigerant to continue through line 26 to the suction side of the compressor 10. It is important to note that, since the coils 13 and 20 are in series, the coldest refrigerant first enters the evaporator coil 13 before entering the desiccant coil 20.

In the straight flow mode, as shown in FIG. 1, the dampers 17A and 17B of the damper assemblies 18A and 18B are positioned to permit the air flow to cross straight across the desiccant coil 19 and the first desiccant coil 19 serves as the regeneration desiccant coil. The regeneration air fan 16 draws desiccant regeneration air 5 straight through the first damper assembly 18A, across the first desiccant coil 19, through the second damper assembly 18B and exhausts it to the outdoors as regeneration air exhaust 6.

The dampers 17C and 17D of damper assemblies 18A, 18B are positioned to allow air to flow straight across the second desiccant coil 20 and the second desiccant coil 20 serves as the process desiccant coil. A portion of the discharged supply air 9 from the evaporator coil 13 is drawn by the desiccant process air fan 15 through the first damper assembly 18A as process air 3, across the second desiccant coil 20, through the damper assembly 18B and discharged as process air exhaust 4 back into the supply air 9 which is conducted into the space to be conditioned 2.

In the refrigeration condensing cycle, the refrigerant pressure is substantially constant throughout the condenser coil 11 and the regeneration desiccant coil 19, and the refrigerant temperature decreases gradually through the series connected coil configurations. The constant condensing pressure is substantially representative of the refrigerant conditions at the saturation dew point, which usually occurs in series, nearer to the end of this condensing cycle.

The desiccant coil 19, as explained hereinafter with reference to FIG. 4A, may be pre-wetted to provide an additional cooling effect to the average refrigerant condensing pressure, temperature, and sub-cooling of the combined condenser adiabatic cooling coil 111 and desiccant regeneration coil 19. The cooling effect of the desiccant coil 19 can be simulated by having the desiccant coil 19 replaced by a typical coil whereby the air crossing the second coil 19 would be entering at a lower temperature than the temperature of the air entering the condenser coil 11. This would result in refrigerant condensing pressure and temperature conditions similar to the effect caused by the second air stream and coil. The evaporative cooling effect from the desiccant coil 19 simulates the lower temperature air stream.

Thus, the regeneration desiccant coil 19 desiccant content provides a de-sorption process, a evaporative cooling effect, a more direct and efficient energy transfer, and enables the refrigerant to augment its energy dissipation, thereby resulting in lower refrigerant pressure and temperature condenser conditions.

This arrangement enables a maximization of both coils 11, 19 which are in series, and allows the hottest superheated refrigerant to be distributed to the condenser coil 11 first to allow a highly efficient energy transfer to occur caused by the temperature differential between the refrigerant and its crossing air stream. Once the refrigerant dissipates its heat at the condenser coil 11 to the crossing air stream, the second desiccant coil 19 serves as the regeneration desiccant coil and provides a supplemental desiccant adiabatic cooling effect that enhances the refrigerant cycle performance and simultaneously provides the refrigerant re-usable energy to regenerate its desiccant content.

In the refrigerant suction or evaporation cycle, the refrigerant pressure is substantially constant throughout the evaporator coil 13 and the process desiccant coil 20, and the refrigerant temperature increases gradually through the series connected coil configurations. The constant evaporating pressure is substantially representative of the refrigerant conditions at the saturation point, which usually occurs in series, nearer to the end of this cycle.

Figure 4A:
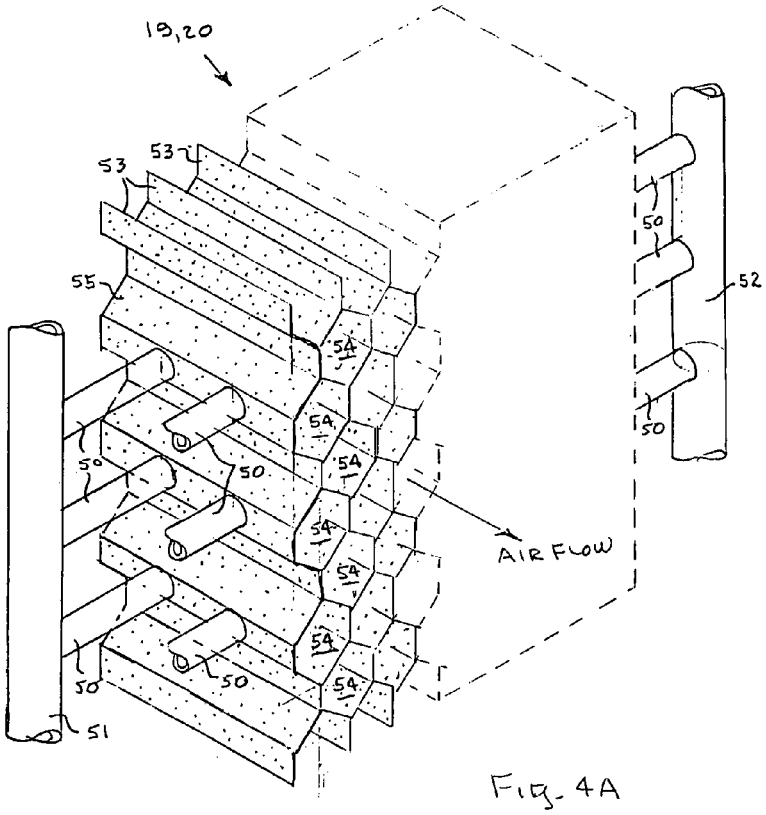
FIG. 4A is a schematic perspective view of a desiccant coil suitable for use in the present system.

The desiccant coil 20, as explained hereinafter with reference to FIG. 4A, is pre-dried to provide an additional sorption and heating effect to the average refrigerant evaporative pressure, temperature, and superheat conditions of the combined evaporator coil 13 and process desiccant coil 20.

The series connected coil configuration 13, 20 provides an adiabatic heating effect wherein the air crossing the process desiccant coil 20 enters at a higher temperature than the temperature of the air entering the evaporator coil 13. This results in augmenting higher refrigerant pressure and temperature conditions.

The desiccant coil 20 provides an adiabatic heating effect. This heating effect can be simulated by having the desiccant coil 20 replaced by a typical coil whereby the air crossing the second coil 20 would be entering at a higher temperature than the temperature of the air entering the evaporator coil 13. This would result in refrigerant evaporative pressure and temperature conditions similar to the effect caused by the second air stream and coil. The sorption adiabatic heating effect from the desiccant coil 20 simulates the higher temperature air stream.

Thus, the process desiccant coil 20 provides a desiccant sorption process, dehumidification and adiabatic heating effect that augments the refrigerant conditions downstream of the evaporator coil 13, and simultaneously decreases the desiccant vapor-pressure conditions to increase the crossing air dehumidification.

The double effect of dehumidification and augmented refrigerant conditions results in refrigerant pressure and temperature conditions similar to the effect of having a co-generation compressor.

The air path sequence provides the second desiccant coil 20 with preconditioned air from the evaporator coil 13. The evaporator coil 13 provides effective sensible energy cooling increasing the air stream vapor ratio condition nearer to vapor saturation. The entering air and temperature and vapor conditions entering the desiccant coil 20 facilitate maximum desiccant evaporator coil energy transfer and sorption for removal of water content in its air stream. Dehumidification occurs with little air temperature increase. The re-heating effect of the desiccant material is substantially absorbed by the passing refrigerant and dissipated little in the air stream leaving the coil 20. Thus the desiccant coil exhaust 4 is dehumidified and slightly re-heated and the desiccant coil 20 more efficiently concentrates its adiabatic energy exchange towards refrigerant suction, super-heat, and temperature and pressure conditions, thereby increasing compressor performance.

The combination of refrigerant and desiccant cycles results in maximizing energy transfer during refrigerant vapor-compression and desiccant vapor-compression, improves system performance and reduces the energy consumption significantly.

The metering device or expansion valve 23 provides a reverse adiabatic refrigerant process and plays an important role in the thermodynamic effects of the desiccant coils on the refrigeration suction cycle and reduces the likelihood of compressor overheating or damage. A preferred metering device is a thermostatic expansion valve having a heat-monitoring bulb that monitors and reacts not only to the superheat but also to the inlet liquid pressure to enable extra capacity fluctuation. Thus, if the inlet refrigerant pressure decreases, it opens its port and allows a greater volume of refrigerant to flow through, and also adjusts the port opening relative to the superheat conditions of the refrigerant to provide an efficient and safe compressor operating condition. The heat-monitoring bulb of the metering device or expansion valve 23 is preferably strategically located to enable maximization of the total refrigeration and desiccant processes.

To further maximize and control the sorption process and effect of the desiccant coil 20, the desiccant process air fan 15 may be modulated, and employed to control the percentage or quantity of process air 3 (portion of the of the discharged supply air 9 from the evaporator coil 13) drawn across the second desiccant coil 20 to provide a steady and controlled process air delivery and conditions anticipating the changing demands of the indoor and outdoor environments. This modulation can either provide low relative humidity delivery air or an added control to deliver steady conditioned air depending on the energy stage of the desiccant coils.

The normally rejected refrigerant energy provided in the refrigeration condensing cycle is used in the present system to provide free work energy to regenerate and compress the vapor content in the desiccant material of the desiccant coils. The desiccant adiabatic cooling effect simultaneously augments the refrigeration cycle and efficiencies. The final desiccant drying stage described below provides an augmented energy transfer from the leaving refrigerant to the desiccant which concurrently maximizes the desiccant conditions prior to switching from the straight airflow mode, depicted in FIG. 1, to the cross airflow mode, depicted in FIG. 2.

When the process desiccant coil 20 has a diminished capacity to attract moisture and after the regeneration desiccant coil 19 is sufficiently dried, the refrigerant path and the direction of the air stream may be switched between the straight airflow, as depicted in FIG. 1, and a cross airflow, depicted in FIG. 2 and described hereinafter, to accommodate the existing conditions of the desiccant coils.

To further maximize the regenerated conditioned of the desiccant coil 19, the condenser fan 12 may be modulated, or conventional refrigerant bypass means may be employed, to increase the pressure and temperature conditions. The condenser fan modulation can be applied for a short duration as the final desiccant drying stage prior to switching the flow of any coils.

The present system results in transferring the normally rejected refrigerant energy from the conventional condenser coil 11 to the desiccant coil 19, thereby increasing its refrigeration pressure and temperature capacity. The concentrated refrigerant energy and increased capacity dissipates the concentrated heat through the desiccant material, thereby increasing the vapor-pressure differential of the desiccant in relation to its crossing air stream and vapor pressure conditions.

As result, the increased refrigerant energy regenerates the desiccant material to a dryer condition prior to the switching to the cross flow mode. In this process, the adiabatic cooling effect of the second desiccant coil 20 provided by the evaporation of the water content in its desiccant material to the passing air stream is not adversely affected because of the transferred increased concentrated refrigerant energy and capacity, which is transferred gradually by modulating the condenser fan of the condenser 11.

Figure 2:
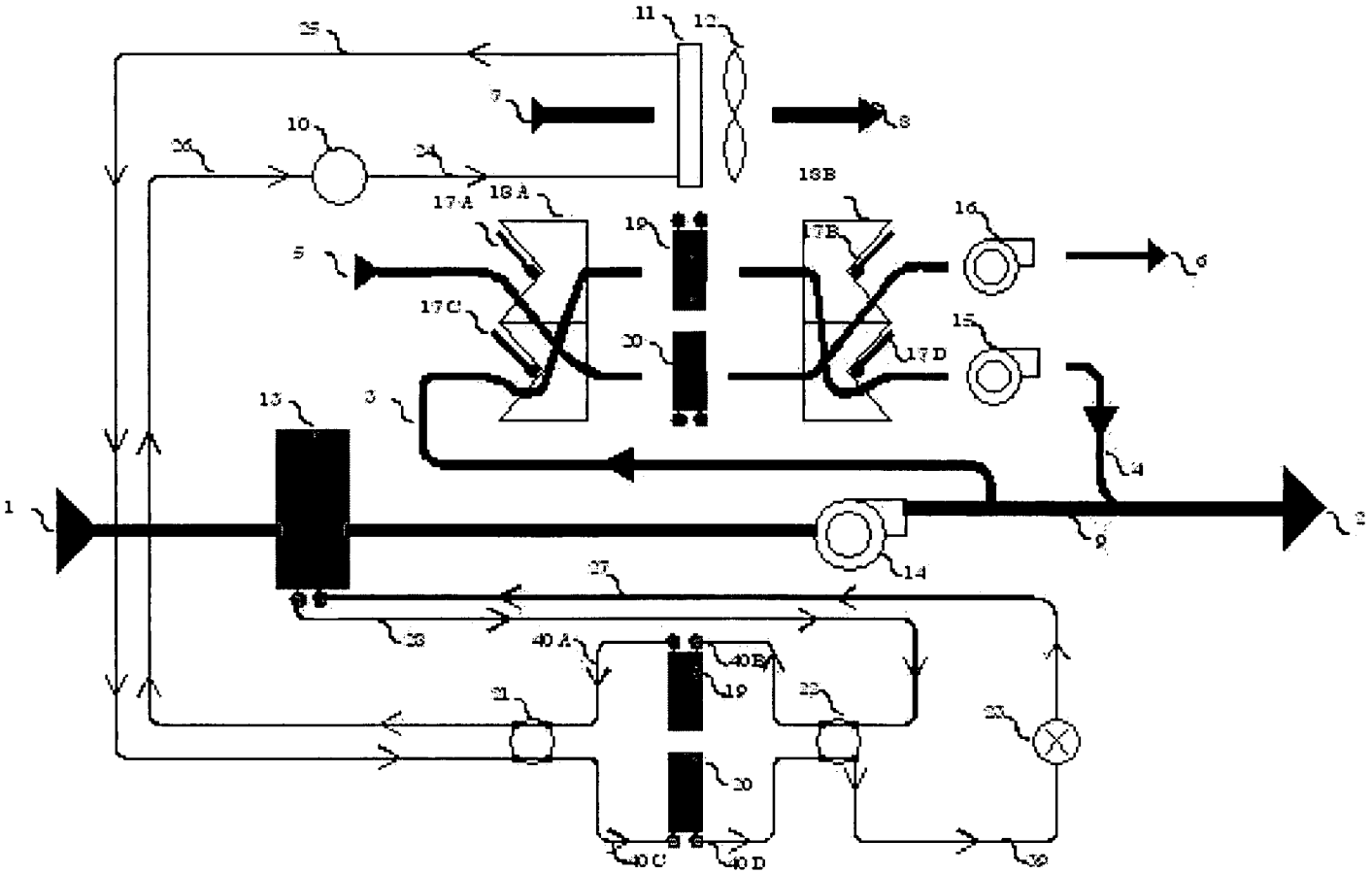
FIG. 2 is a diagrammatic view illustrating the components of the air conditioning system showing the airflow and refrigerant paths for routing the air and refrigerant through the coils in a cross flow cooling mode of operation.

The sorption process and adiabatic heating effect of the desiccant coil 20 provides normally rejected work energy which is used in the present system in series with the refrigerant compressor 10 to serve as a co-generator in the refrigeration cycle, allows simultaneous rapid cooling of the desiccant, accelerates dehumidification of its air stream with no appreciable sensible heat added to the air stream, and allows the accumulation of moisture prior to switching from the straight airflow mode, depicted in FIG. 1, to the cross airflow mode, depicted in FIG. 2, and prepares itself for the switching to be regenerated. The metering device or expansion valve 23 functions to prevent overheating of the compressor 10, controls the co-generator energy effect provided by the process desiccant coil conditions, and shifts the absorbed energy for use in the refrigerant suction cycle to augment the cooling process instead of co-generation.

In a combined refrigerant closed cycle and desiccant open cycle, the refrigerant path is continuous and the desiccant cycle lags the refrigeration cycle by one process. In other words, the refrigerant compression process occurs during the desiccant sorption process; the refrigerant condensing process occurs during the desiccant regeneration process; the refrigerant expansion process occurs during the desiccant de-sorption process; and the refrigeration evaporative process occurs during the desiccant expansion process.

In a refrigerant closed cycle and desiccant switching cycle (described below), the air and refrigerant paths are switched between the desiccant coils 19 and 20 so that two sets of processes occur at the same time. In other words, the desiccant de-sorption and regeneration process occurs at the same time as the refrigerant expansion and condensing process, and while the desiccant sorption and expansion process are also occurring at the same time as the refrigeration compression and evaporation process. Both the desiccant open cycle and switching cycle result in the same effect and enables the maximum transferable, reversible, interchangeable energies to occur between its agents to improve effective cooling in the process air stream. Each occurring refrigeration process simultaneously improves each occurring desiccant processes and vice versa.

Alternatively, the compressor 10 may also be sequenced to stop and consequently stop the refrigeration effect provided to the desiccant coil 20. As result of dehumidification re-heating of the air stream occurs to balance the desiccant enthalpy and no energy is absorbed by the refrigeration process. The discharged desiccant process air 4 delivers less dehumidification but provides a sensible re-heat effect until the desiccant and air stream vapor-pressure difference reaches equilibrium. This alternate mode also accommodates the water residue usually remaining on the evaporator coil 13, which re-evaporates into its air stream after the compressor has stopped.

If at anytime during normal operation, prior to the final desiccant drying process, the desiccant moisture becomes insufficient to provide adequate adiabatic cooling, additional water may be added to augment and enable the refrigerant cooling effects to occur. Adding water can damage the pores of the desiccant, so preferably the water is added into the air stream before crossing the coil. The desiccant then would interchange its moisture and energy content with the air stream resulting a favorable cooling effect of the refrigerant.

It should be understood that both dampers 17A, 17B of the damper assemblies 18A, 18B may be positioned to permit a portion of the outdoor air intake 5 to mix with the desiccant process air 3 to provide adequate fresh air and also permit the process intake air 3 to be exhausted to the outdoor exhaust 6. This control could be considered as a pressure-building device and/or air exchanger and has the benefit of re-using the conditioned space air 2 to facilitate the cooling effect of the regeneration desiccant coil.

CROSS FLOW COOLING MODE

Referring now to FIG. 2, the components of the system are shown in the cross flow mode of operation. The same components are assigned the same numerals of reference but will not be described again in detail to avoid repetition. However, as described below, in this mode the pre-moistened process desiccant coil 20 (second coil 20) becomes the desiccant regeneration coil and the dried regeneration coil 19 (first coil 19) becomes the process desiccant coil. The switching occurs when the process desiccant coil 20 has a diminished capacity to attract moisture and after the regeneration desiccant coil 19 has sufficiently dried. Thus, their roles are reversed, and the state of their previous moisture conditions initiate a fresh new cycle and effects.

In this mode the first and second reversing valves are positioned such that cooled refrigerant from the condenser coil 11 flows through line 25, to the first reversing valve 21 which directs the refrigerant via line 40C through the second desiccant coil 20, through line 40D to the second reversing valve 22 which directs the refrigerant via line 39 through the metering device or expansion valve 23, and through line 27 into the evaporator coil 13. When the high-pressure cooled refrigerant passes through the metering device or expansion valve 23, it is restricted and it enters the evaporator coil 13 at a lower temperature and pressure. The refrigerant passing through the evaporator coil 13 absorbs heat from the process air 1 drawn across the coil by the process air fan 14 and air exiting the evaporator coil is discharged as cool air, at a lower temperature and higher vapor-pressure. After passing through the evaporator coil 13, the refrigerant passes through line 28, back through the second reversing valve 22, through line 40B, through the first desiccant coil 19, and through line 26 to the suction side of the compressor 10.

Also, in this mode, the dampers 17A, 17B, 17C and 17D of the first and second damper assemblies are positioned such that a portion of the discharged supply air 9 from the evaporator coil 13 is drawn by the desiccant process air fan 15 through the first damper assembly 18A as process air 3, across the first desiccant coil 19 (now becoming the process desiccant coil), through the damper assembly 18B and discharged as process air exhaust 4 back into the supply air 9 which may be conducted into the space to be conditioned 2; and desiccant regeneration air 5 is drawn by the regeneration air fan 16 through the first damper assembly 18A, across the second desiccant coil 20 (now becoming the wetted desiccant regeneration coil), through the second damper assembly 18B and is exhausted to the outdoors as regeneration air exhaust 6.

As described previously, when the process desiccant coil reaches the state of having a diminished capacity to attract moisture, and after the regeneration desiccant coil is sufficiently dried, the refrigerant path and the direction of the air stream may be switched repetitively between the cross airflow and the straight airflow and vice versa, as depicted in FIG. 1, and FIG. 2. Also, as stated previously, at any time prior to switching, the condenser fan can be modulated to augment the regeneration coil desiccant dryness condition. Switching the coils facilitates the desiccant sorption and de-sorption process, and it transfers the water content from the process air into the regeneration air stream.

Figure 3:
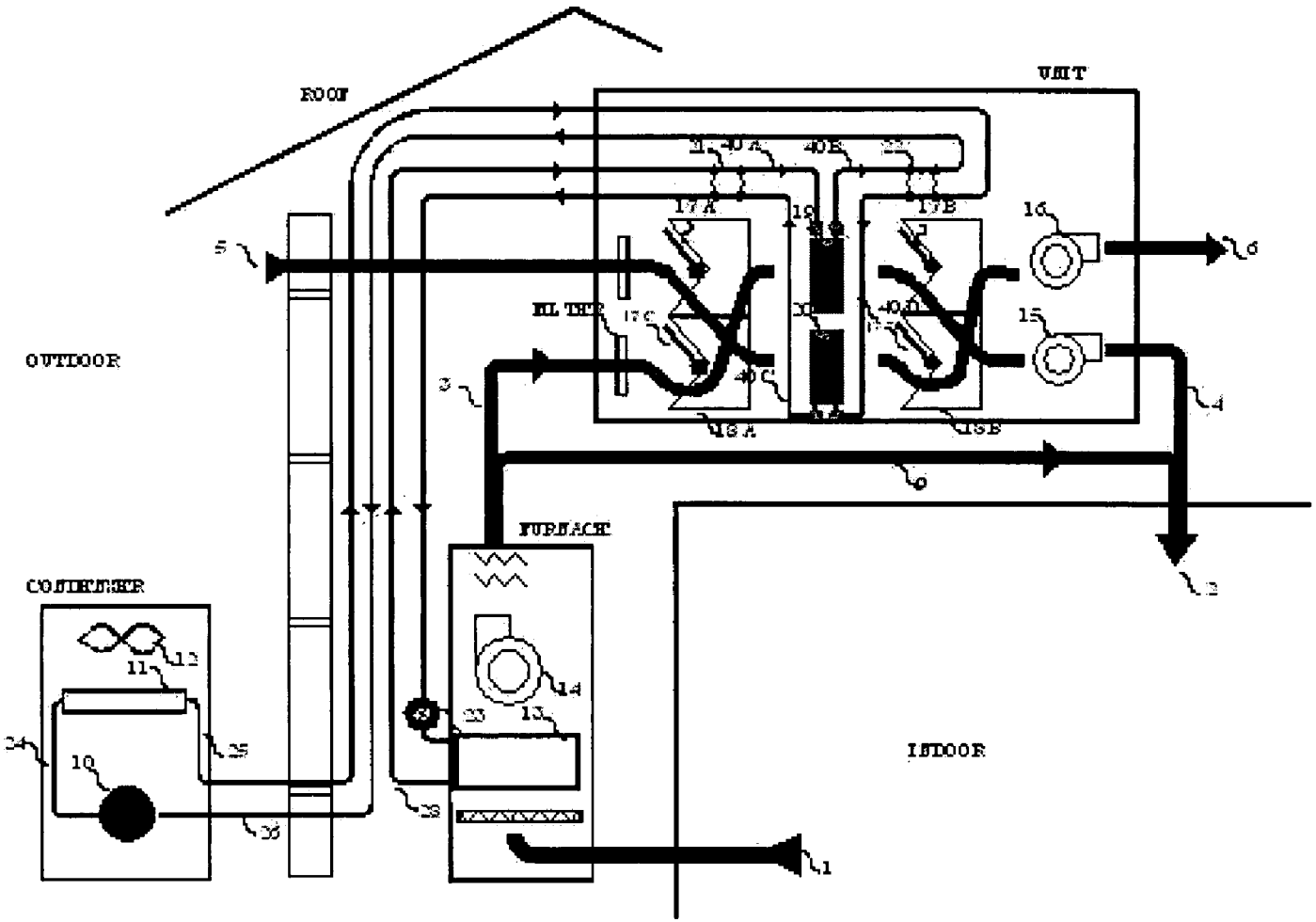
FIG. 3 illustrates schematically the air conditioning system with the components incorporated in a conventional building air conditioning system and showing the airflow and refrigerant paths for routing the air and refrigerant through the outdoor condensing unit and through the coils in the cross flow cooling mode of operation, similar to FIG. 2.

FIG. 3 illustrates schematically the air conditioning system with the components incorporated in a conventional building air conditioning system and showing the airflow and refrigerant paths for routing the air and refrigerant through the outdoor condensing unit and through the coils in the cross flow cooling mode of operation, similar to FIG. 2.

The Desiccant Coils

The desiccant coils 19, 20 are similar to a conventional heat exchanging finned refrigerant coil having refrigerant conducting conduit or tubing with a plurality of metal fins that provide a large heat exchange surface area to a passing air stream and shaped to enhance both the capture and release of moisture.

FIG. 4A illustrates somewhat schematically, an example of a finned desiccant coil suitable for use in the present system. It should be understood that desiccant coils of various other designs may be used in the present system, and the present invention is not limited to the illustrated example. The coils 19, 20 each have a number of rows of metallic conduit or tubing 50 connected with metallic header pipes 51, 52 for conducting refrigerant therethrough in a serpentine path, as is conventional in the art. A plurality of metallic fins 53 are secured to the refrigerant tubes to form a generally rectangular configuration having a plurality of transverse air pathways 54. In the example shown, the adjacent fins 53 have a corrugated shape and form a honeycombed pattern air pathway 54 to increase the surface area and enhance the capture of moisture from the crossing air. Both surfaces of the metallic fins 53 are coated with a desiccant material 55, as described below. It should be understood that desiccant material may be interspersed between the fins, and that a substrate material may be combined with the desiccant material to provide adequate bonding and thickness.

A preferred desiccant material for use with the present desiccant coils is an activated alumna desiccant material that has significant adsorption capacity for water at a relative high humidity, which typically occurs in the process air stream downstream from the evaporator coil 13. The activated alumna can be regenerated under air and refrigerant operating conditions during the air conditioning or refrigeration process.

In constructing such a coil, the coil surface is coated with the desiccant using a sol-gel process wherein a stable boehmite sol is used as the precursor for coating the alumna on a fin assembly. The boehmite is commercially available in powder form and is mixed into water to form the stable boehmite sol and is stabilized with an acid solution to charge the surface of boehmite particles. The boehmite sol solution is then sheared to a predetermined thickness. The desiccant coil is washed in diluted acid for cleaning. The coil is dipped into the boehmite sol solution and then heat treated for a period of time sufficient to convert the boehmite sol thin liquid film into boehmite gel when the solvent is removed during a drying process, and the boehmlte gel is then converted into gamma-alumina during calcinations.

Even though the activated alumna provides an effective moisture adsorbent, it does not provide adsorption for a full range of contaminant or unwanted gases such as carbon dioxide, carbon monoxide, ozone, sulfur dioxide, nitrogen dioxide, formaldehyde and combinations thereof. It should be understood that the desiccant may also be impregnated with additional substances to improve the sorbant effectiveness for these unwanted gases. Filtration of these unwanted gases can also result in lowering the carbon dioxide levels in the outdoor or fresh air intake, which can reduce energy consumption.

In the regeneration desiccant coil 19, the internal condenser refrigerant energy provides free work energy which directly increases the temperature of the coil fins and desiccant coating vapor-pressure relative to its crossing air stream. As result, of the vapor-pressure differential between the desiccant and the air stream the moisture is evaporated to the air stream. This evaporation process provides an adiabatic cooling effect that can either cool the refrigerant or the air stream. Since sensible energy travels by temperature differential, the refrigerant being more elevated than the crossing air stream dissipates its energy into the desiccant and results in an added cooling process in the refrigerant condensing cycle.

The increased evaporation rate also causes a sensible energy decrease or cooling effect of the conductive fin material of the desiccant coil. This effect is similar to a sling psychrometer having a thermometer bulb wrapped in a moist cloth and swung in an air stream. In this comparison, the fin acts as the surrounded thermometer bulb and its temperature is lowered by the evaporation of water contained in the desiccant. At a constant enthalpy, the vapor-pressure between the cloth (desiccant) and its passing air stream attempts equilibrium and results in the sensible cooling effect caused by vaporization and decreases the temperature of the thermometer (metal fin).

The desiccant de-sorption process simultaneously provides an adiabatic cooling effect in the refrigeration cycle from the existing stored moisture content, which is released and evaporated in the passing air stream. In the condenser cycle, the energy relationship and capacity between the entering air stream conditions, the refrigerant entering conditions, and the moisture content conditions of the desiccant coil provides a favorable combination to enable most of the energy transfer to occur in the refrigerant. However, energy is also transferred in its passing air stream as sensible re-heat in relation to its wet bulb temperature condition.

In a typical evaporator coil at low temperature suction, ice can build up on the coil and due to the insulation effect of the ice; the thermal energy transfer efficiency is reduced.

Depending on the wetted condition of the desiccant in the regeneration desiccant coil and its capacity, the water content in the desiccant is evaporated and it also gradually acts as an insulator, thereby diminishing its ability to efficiently transfer heat to the air stream and consequently affect the refrigeration cycle. As result, the condition of the refrigerant then also increases and accelerates the drying level of the desiccant. This feature enables the energy to be applied to the moisture content on the fins. Although activated alumina is capable of withstanding frost build up, it should be understood that the desiccant thickness may be decreased in some low temperature applications to prevent damage to its desiccant pores.

In the present system, the water content is supplied by the switching of the pre-conditioned process desiccant coil 20. Adding water can also benefit the evaporative cooling effect generated to the refrigerant process. A preferable adiabatic humidifying device disposed upstream of the regeneration desiccant coil will enable the moisture between the air stream and the desiccant to interchange and provide adiabatic cooling to the refrigerant process air stream.

The cooling effect of the metallic fins and conduit piping cools the refrigerant directly and provides additional cooling to the refrigeration cycle, which augments its energy performance and compressor energy ratio, and facilitates efficient desiccant coil regeneration.

As described previously with reference to FIGS. 1 and 2, the desiccant coil needs to be dried and regenerated just before the switching of the coils, wherein the desiccant regeneration coil becomes the process desiccant coil and vice versa. The dried desiccant condition of the process desiccant coil provides work energy to either the internal refrigerant or external air. The vapor-pressure differential between the desiccant content and the crossing air dehumidifies the air and dehumidification results in an adiabatic heating effect. Sensible energy travels by temperature differential, and since the refrigerant temperature is lower than the crossing air stream, the desiccant dissipates most of its energy into the refrigerant. The refrigerant absorbs the desiccant energy and results in acceleration of the dehumidification process.

The regenerated desiccant coil has lower desiccant temperature and vapor-pressure conditions, which enable the attraction of water through its energy exchange. The desiccant sorption process simultaneously provides an adiabatic heating effect to the refrigeration evaporator cycle and dehumidification of its passing air stream. As a result, the refrigerant evaporation or suction increases and the desiccant temperature and vapor-pressure differential are lowered relative to its air stream, thereby accelerating its rate of sorption in an attempt to balance the enthalpy equilibrium.

In the evaporator cycle, the direction of energy transfer of the pre-dried desiccant coil to either the refrigerant or the air stream is dependent upon the relationship between the entering air stream conditions and the temperature of the entering refrigerant. Also as described above, the pre-dried desiccant can also become an insulator. It restricts the sensible energy thermal conduction exchange between the refrigerant and passing air, yet allows vapor pressure to travel efficiently.

It is also important to note that the pre-cooling of the entering air of the process desiccant coil provides a saturated vapor-pressure condition that produces a very favorable air-vapor condition that enables the most efficient desiccant energy output to provide dehumidification. The desiccant refrigerant absorption through the fins and conduit of the coil also directly cools the desiccant, results in dehumidification in its air stream and provides additional adiabatic heating to the refrigeration cycle increasing its ability to moisten the desiccant coil.

The present desiccant coil arrangement incorporates both refrigerant vapor-compression technology and desiccant vapor-compression technology and combines the internal and external exchange of energy of both systems.

Figure 4B:
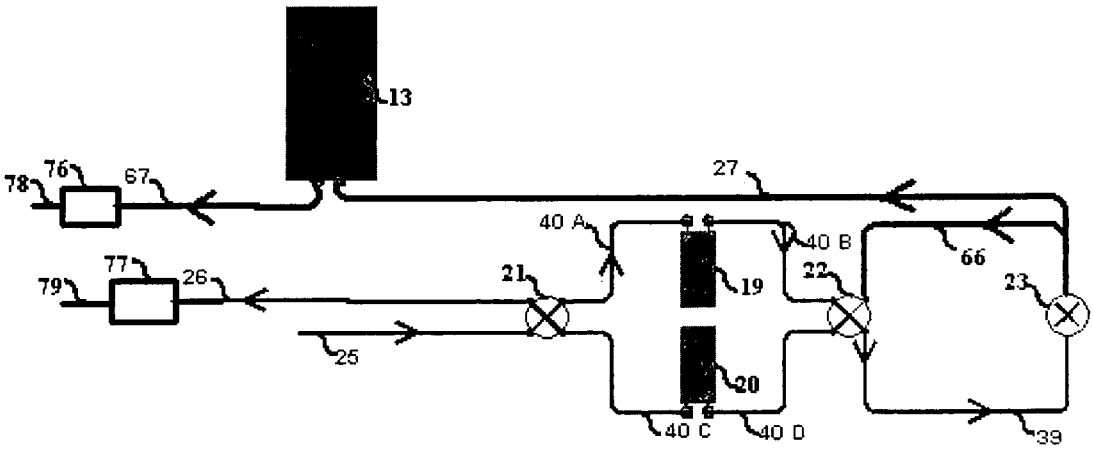
FIG. 4B is a diagrammatic view illustrating an alternate evaporator and desiccant coil parallel/series arrangement for the present air conditioning system.

FIG. 4B is a diagrammatic view illustrating an alternate evaporator and desiccant coil parallel/series arrangement for the present air conditioning system. In this arrangement, the condensed refrigerant from the condenser 11 (shown in FIG. 1) flows through the liquid line 25 to the first reversing valve 21 which directs it via line 40A through the first desiccant coil 19, and then via line 40B to the second reversing valve 22 which directs it via line 39 to the metering device or expansion valve 23. The air path is the straight flow path previously shown and described with reference to FIG. 1.

The refrigerant path differs from FIG. 1 in that, after passing through the metering device or expansion valve 23, the refrigerant flows in parallel to either the evaporator coil 13 through line 27 or through line 66 back to the second reversing valve 22. If it is directed through the evaporator coil 13, the refrigerant from the evaporator coil flows through evaporator suction line 67 and an evaporator pressure regulator 76 and then through line 78 to the compressor or a rack system. If the refrigerant is directed back to the second reversing valve 22, it flows via line 40D through the second desiccant coil 20 then via line 40C to the first reversing valve 21 which directs it via line 26 through an evaporator pressure regulator 77 then though line 79 to the suction side of the compressor or rack system.

The refrigerant energy transfer capabilities in this arrangement also differ from FIG. 1 in that both evaporator pressure regulator valves 76, 77 enable dual refrigerant temperatures that concentrate refrigeration absorption energy to either the evaporator coil 13 or the second desiccant coil 20, which are in parallel and provide different air delivery output exhaust conditions. The parallel coil arrangement allows refrigerant intake conditions to be the same at the evaporator coil 13 and the desiccant coil 20, provides control of various process air delivery outputs, and allows concentrated refrigeration absorption energy to be provided proportionally to either coil.

Increasing the absorption capacity in the desiccant coil 20 augments dehumidification and decreases any re-heat and can also contribute to the sensible cooling effect in its air stream. Lowering the absorption capacity reverses the process; it diminishes any sensible cooling effect then adds to re-heat and lower dehumidification ability.

In the refrigeration cycle, either in the suction or liquid side, the refrigerant pressure is constant and its temperature changes gradually in the series in coil configurations and results in an average total output depending upon the coil conditions. In this process, compared to the arrangement of FIG. 1, the results may decrease the energy consumption but still provide adequate delivery air for the purpose intended. The evaporator constant pressure is substantially a direct representation of the refrigerant conditions at the saturation point, and compared to FIG. 1, can result in a less effective refrigeration cycle. The adiabatic heating effect can be almost non-beneficial to the refrigerant suction cycle.

Alternatively, augmented compressor capacity may be provided to compensate for the less efficient refrigeration cycle and provide adequate process air delivery for the purpose intended. Increasing the absorption capacity in either the evaporator coil or process desiccant coil enables lower air conditions to occur and vice versa.

It should be understood that, in the arrangement of FIG. 4B, the refrigerant path and the direction of the air stream across the desiccant coils may be switched between the cross airflow and the straight airflow and vice versa, as depicted in FIGS. 1 and 2.

Figure 5:
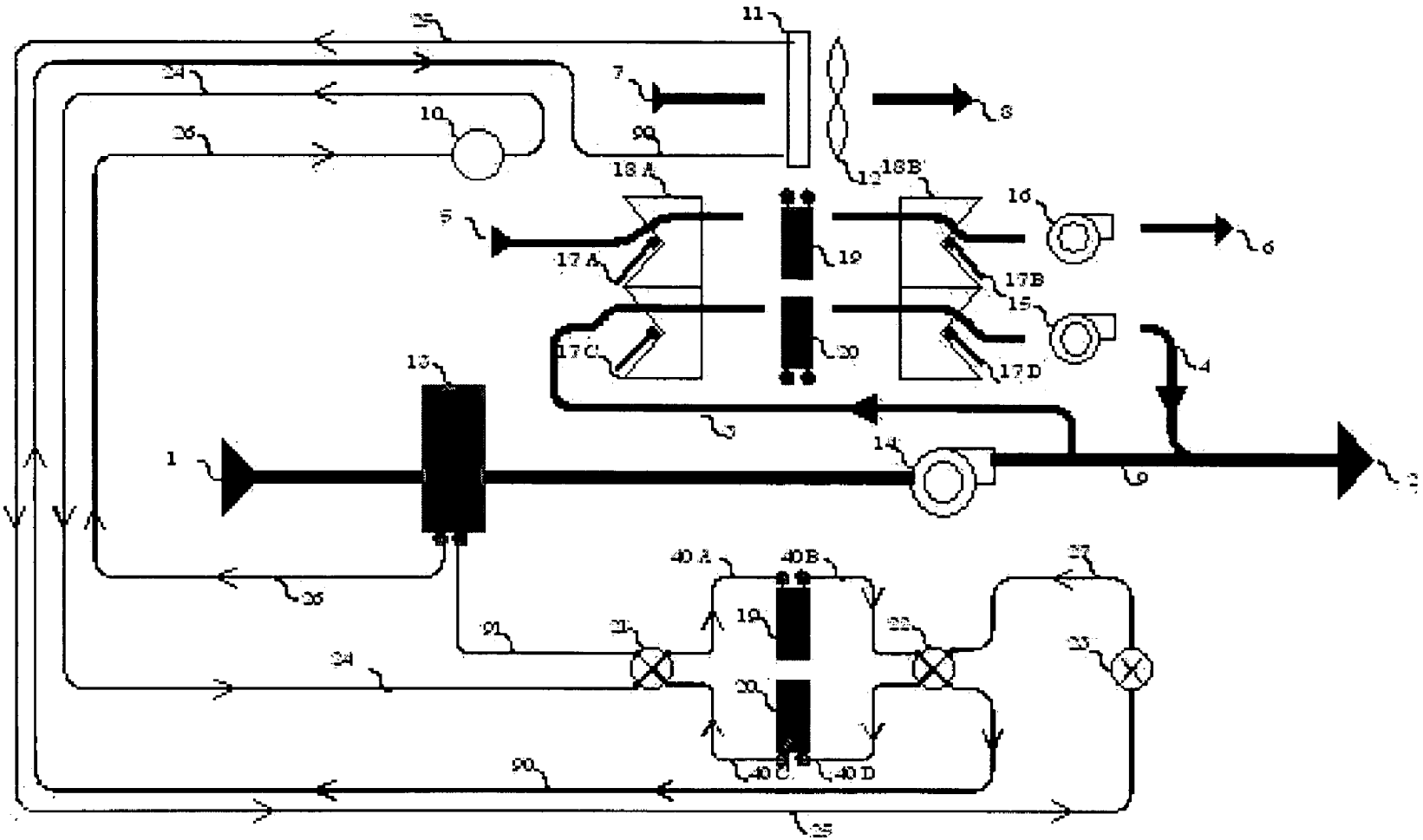
FIG. 5 is a diagrammatic view illustrating the components of the air conditioning system showing the airflow and refrigerant paths for routing the air and refrigerant through the coils in an augmented straight flow dehumidification mode of operation.

FIG. 5 is a diagrammatic view, somewhat similar to FIG. 1, illustrating an arrangement for providing an augmented straight flow dehumidification mode of operation. The refrigerant path differs from FIG. 1 in that, in this arrangement, the refrigerant discharged from the compressor 10 first flows through the liquid line 24 to the first reversing valve 21 which directs it via line 40A through the first desiccant coil 19, and then via line 40B to the second reversing valve 22 which directs it via line 90 to condenser coil 11. The condensed refrigerant from the condenser coil 11 flows via line 25 through the metering device or expansion valve 23 then via line 27 to the second reversing valve 22 which directs it via line 40D through the second desiccant coil 20, and then via line 40C to the first reversing valve 21 which directs it via line 91 to the evaporator coil 13. After passing through the evaporator coil 13, the refrigerant passes through line 26 to the suction side of the compressor 10. The air path is the straight flow path previously shown and described with reference to FIG. 1 and the refrigerant path and the direction of the air stream across the desiccant coils may be switched between the cross airflow and the straight airflow and vice versa, as described previously.

This arrangement provides the hottest refrigerant from the compressor 10 to accelerate and increase the regeneration drying condition of the desiccant coil 19 and thereby augments the dehumidification capabilities. Although this arrangement provides rapid and concentrated refrigerant rejected energy to occur in the desiccant coil 19, it also diminishes the total condenser refrigerant performance and efficiency as compared to the arrangement of FIG. 1. Since the adiabatic effect of the desiccant coil 19 cools, in part, what the condenser coil 11 has the ability to do, it does not concentrate its total ability toward an added cooling effect. In the refrigeration cycle, either in the suction or liquid side, the refrigerant pressure is constant and its temperature changes gradually in the series in coil configurations and results in an average total output depending upon the coil conditions.

The arrangement of FIG. 5 also differs from the arrangement of FIG. 1 in that the adiabatic cooling effect of the regeneration desiccant coil 19 is not as effective, since the coil 19 is in series before the condenser coil 11 and has the hottest refrigerant, it reduces the effectiveness of the condenser coil 11 and the heat dissipation of the combined coil arrangement, thus the series connected coil arrangement is somewhat less effective in the refrigeration condensing cycle. Also in this arrangement, the coldest refrigerant enters the second desiccant coil 20 then passes through the evaporator coil 13, thus the refrigerant absorption capacity is concentrated toward reducing the desiccant vapor-pressure and temperature conditions and thereby augmenting the desiccant condition differential relative to the air stream and as a result increased dehumidification occurs. Also having the desiccant coil 20 first in series to the metering device or expansion valve 23 does not contribute to the maximum refrigeration cycle performance.

Although the arrangement of FIG. 5 has a somewhat diminished refrigeration energy ratio, the benefits derived by the increased vapor-pressure differential desiccant cycle may desirable in some applications. If dehumidification is a must, augmented compressor capacity could be increased to compensate for the reduced refrigeration cycle efficiency to produce drier delivery air. Thus, the arrangement of FIG. 5 is based on providing dehumidification at lower relative humidity.

It should be understood that, in the arrangement of FIG. 5, the refrigerant path and the direction of the air stream across the desiccant coils may be switched between the cross airflow and the straight airflow and vice versa, as depicted in FIGS. 1 and 2.

Figure 6A:
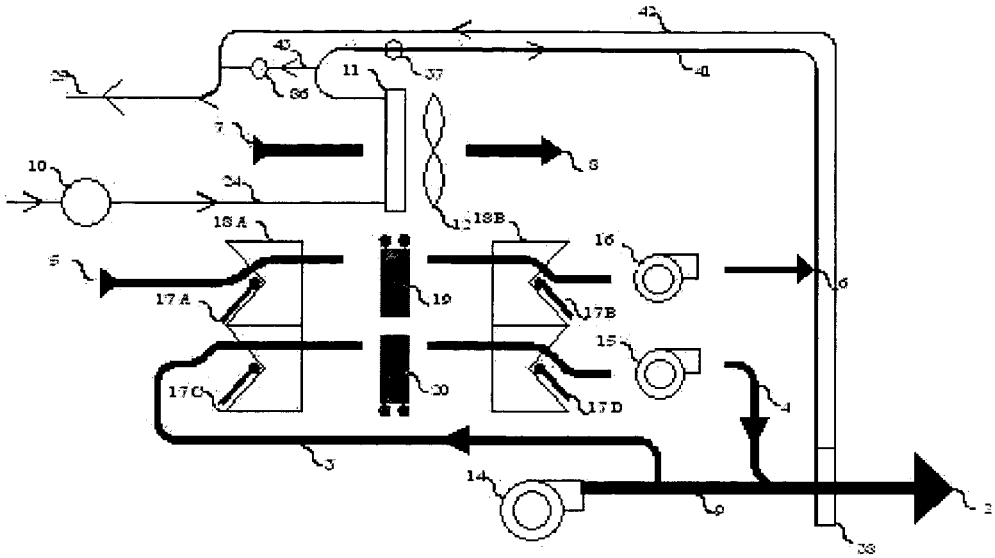
FIG. 6A is a partial diagrammatic view illustrating the components of the air conditioning system having an alternate coil arrangement and showing the airflow and refrigeration path for routing the air and refrigerant through the coils in straight flow condenser reheating mode of operation

FIG. 6A is a partial diagrammatic view illustrating an alternate coil arrangement for providing a condenser reheating mode of operation. The airflow path for routing the air through the coils is shown in the straight flow path, and the compressor 10 discharges superheated refrigerant through the discharge refrigerant line 24 to the condenser coil 1, as shown in FIG. 1.

In this arrangement, an alternate refrigerant path is provided after the condenser coil 11. The refrigerant exits the condenser coil 11 through line 41 and passes through a first solenoid valve 37, which is open, allowing the refrigerant to flow through a condenser reheat coil 38 and then through line 42 to the condenser coil liquid line 25. A refrigerant bypass line 43 is disposed between the line 41 and the condenser liquid line 25 and contains a second solenoid valve 86, which is in a closed condition. The process air blower or fan 14 draws process air 1 across the evaporator coil 13 (as shown in FIG. 1) and discharges it as supply air 9 (which may also contain desiccant process discharge air 4 from the desiccant coils, as described previously). The supply air 9 is conducted across the condenser reheat coil 38, and into the space to be conditioned 2.

When the second solenoid valve 86 in the refrigerant bypass line 43 is opened to allow flow and the first solenoid valve 37 in the line 41 is closed, the system functions the same as the arrangement of FIG. 1. The arrangement of FIG. 6A utilizes normally rejected energy in the bypass condenser re-heating process and provides additional diversity in the process air delivery conditions to accommodate different demands and conditions. The fan motor 12 of the condenser coil 11 maybe stopped or modulated to rapidly transfer the refrigerant energy toward the condenser reheat coil 38 to augment the re-heating energy if needed. It should be understood that the system may be sequenced to prepare the desiccant prior to switching the condensers for regenerating the desiccant, as described previously, and that other types of refrigerant pressure controls may be utilized.

The re-heating process is optional, however, if the condenser re-heating is required permanently and/or if the process air flow is sufficient to reject the refrigerant energy, the condenser coil 11 and solenoid valves 27 and 86 could be eliminated.

Figure 6B:
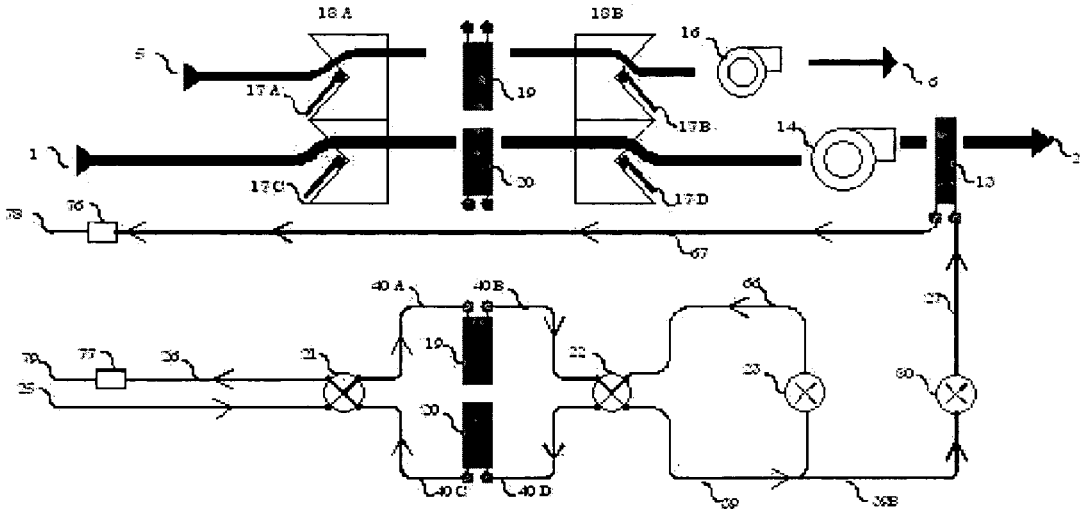
FIG. 6B is a partial diagrammatic view illustrating an alternate evaporator and parallel/series desiccant coil arrangement.

FIG. 6B is a partial diagrammatic view illustrating an alternate evaporator and parallel/series desiccant coil arrangement. This arrangement differs from FIG. 1 in that the evaporator coil 13 is located downstream from the process air blower or fan 14. The process air blower or fan 14 draws process air 1 across the second desiccant coil 20 and discharges it across the evaporator coil 13 into the space to be conditioned 2.

The refrigerant suction path is somewhat similar that shown in FIG. 4B. Both the evaporator 13 and the process desiccant coil 20 are in parallel. The line 39 between second reversing valve 22 and the metering device or expansion valve 23 is adjoined to the refrigerant line 39B which extends to the evaporator coil 13 and contains an additional metering device or expansion valve 80 to control refrigerant flow into the evaporator coil.

In this arrangement, the condensed refrigerant from the condenser 11 (shown in FIG. 1) flows through the liquid line 25 to the first reversing valve 21 which directs it via line 40A through the first desiccant coil 19, and then via line 40B to the second reversing valve 22. After passing through the second reversing valve 22, the refrigerant flows via line 39 either through the first metering device or expansion valve 23 and line 66 back to the second reversing valve 22, or flows via line 39B through the second metering device or expansion valve 80 into the evaporator coil 13, depending upon the control settings of the first and second metering devices or expansion valves 23 and 80. Refrigerant passing through the evaporator coil 13 flows through evaporator suction line 67 and an evaporator pressure regulator 76 and then through line 78 to any compressor or rack system. If the refrigerant is directed back to the second reversing valve 22, it flows via line 40D through the second desiccant coil 20 then via line 40C to the first reversing valve 21 which directs it via line 26 through an evaporator pressure regulator 77 then though line 79 to the suction side of the compressor or rack system.

In a low/mid temperature application, frost will typically tend to build up on any evaporator coil and if moisture is removed from the entering air before entering the coil, it would result in less frost build up on the evaporator coil. The arrangement of FIG. 6B removes the moisture content of the intake air before the process airflow crosses the evaporator coil 13 to provide a defrosting method that does not require system shut down to defrost, significantly reduces or eliminates water/ice build up on the desiccant coils, enables maximum utilization of energy, and provides effective dehumidification, temperature and vapor pressure output.

Figure 7:
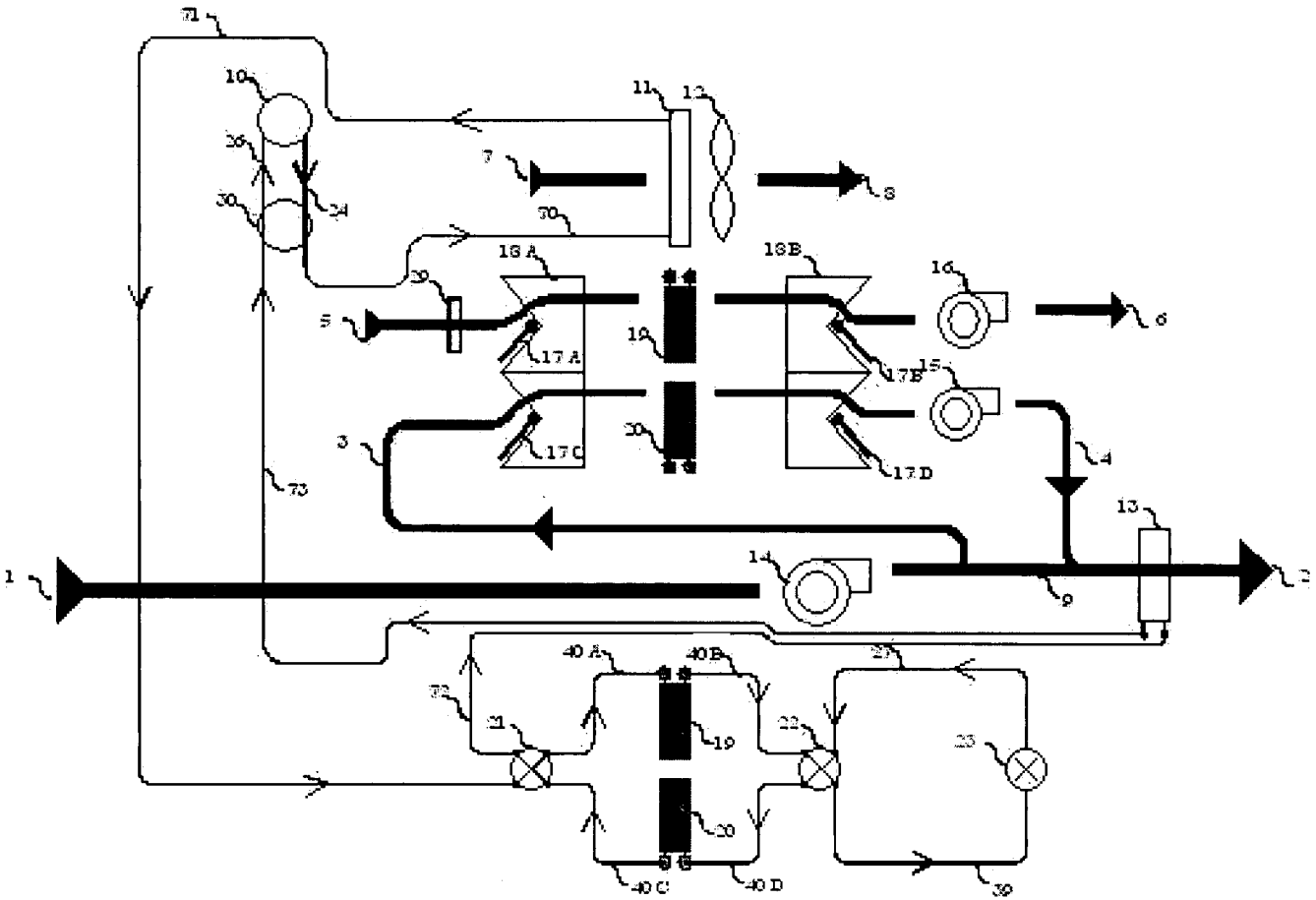
FIG. 7 is a diagrammatic view illustrating the components of the air conditioning system in an alternate heat pump/dehumidification/humidification air conditioning arrangement and showing the airflow and refrigeration path for routing the air and refrigerant through the coils in a straight flow cooling mode of operation.
Figure 8:
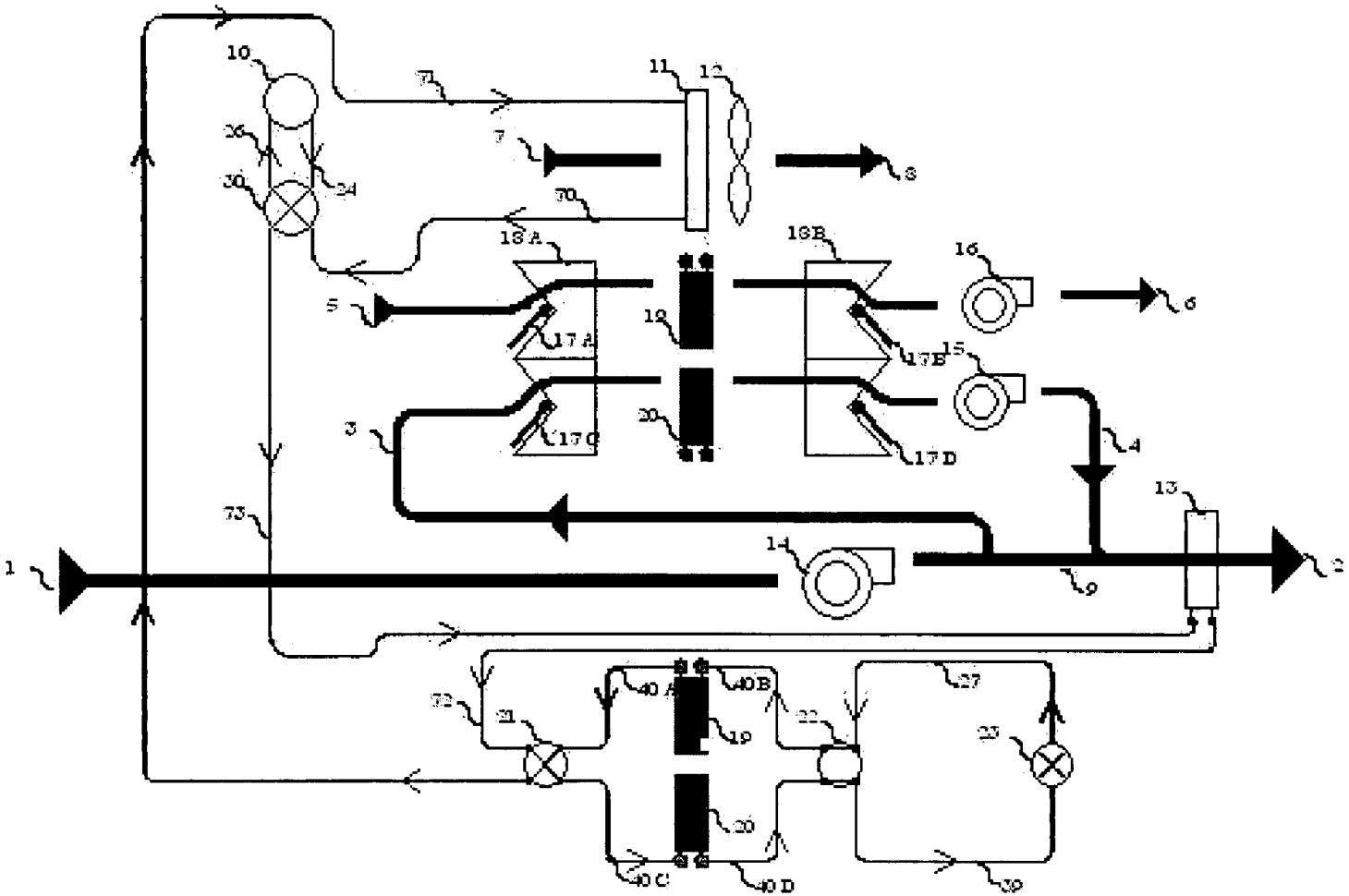
FIG. 8 is a diagrammatic view, similar to FIG. 7, showing the airflow and refrigeration path for routing the air and refrigerant through the coils in a straight flow heat pump heating mode of operation.

FIGS. 7 and 8 are diagrammatic views illustrating an alternate heat pump air conditioning arrangement, with the airflow and refrigeration path for routing the air and refrigerant through the coils in a straight flow cooling mode of operation shown in FIG. 7, and in a straight flow heat pump heating mode of operation shown in FIG. 8. The airflow and refrigeration path for routing the air and refrigerant through the coils are somewhat similar in segments to the arrangement shown and described above with reference to FIGS. 1, 5 and FIG. 6B and the same components and flow paths are assigned the same numerals of reference but will not be described again in detail to avoid repetition. The air path is similar to FIG. 1 except that the evaporator coil 13 is located in the supply air stream prior it being discharged to the space to be conditioned as shown in FIG. 6B. The refrigerant condensing cycle is configured as in FIG. 1 and the evaporator process cycle is configured as in FIG. 5.

In this arrangement, the process air blower or fan 14 draws in process air 1 and discharges it as supply air 9 (which may also contain desiccant process discharge air 4 from the desiccant coils, as described previously) across the evaporator coil 13, and into the space to be conditioned 2. An alternate refrigerant path and an additional reversing valve 30 are provided between evaporator coil 13 and the suction side of the condenser coil 11. For proper heat pump terminology, the condenser coil 11 is referred to in this arrangement as the outdoor coil 11 and the evaporator coil 13 is referred to as the indoor coil.

The condensed refrigerant exits the condenser coil or outdoor coil 11 through line 71 and passes to the first reversing valve 21, which directs it via line 40A through the first desiccant coil 19, via line 40B to the second reversing valve 22, which directs it via line 39 through the metering device or expansion valve 23, and via line 27 back to the second reversing valve 22, which directs it via line 40D through the second desiccant coil 20 and via line 40C back to the first reversing valve 21, to achieve the adiabatic cooling and desiccant regeneration effect as described in detail previously with reference to FIG. 1. After returning to the first reversing valve 21, the refrigerant passes through line 72 and through the evaporator coil or indoor coil 13 and via line 73 back to the heat pump reversing valve 30 which is positioned to direct it through line 26 to the suction side of the compressor 10. The refrigerant is discharged from the compressor 10 through line 24 and back through the heat pump reversing valve 30 and via line 70 to the suction side of the condenser coil 11. It should be understood that the refrigerant path and the direction of the air stream across the desiccant coils may be switched between the straight airflow and the cross airflow and vice versa, as depicted in FIGS. 1 and 2. The switching of the refrigerant path and the sequence of the reversing valves 21 and 22 are also similar to FIGS. 1 and 2. This arrangement is slightly less effective in its refrigeration cycle compared to the arrangement of FIG. 1, but provides an increased dehumidification effect as described previously with reference to FIG. 5.

As is well known in the art, proper sizing of a heat pump system requires calculating both heating and cooling loads, and it is difficult to "oversize" a typical heat pump to accommodate the heat load system due to its diminished capacity to dehumidify if oversized in its cooling mode. The arrangement of FIGS. 7 and 8 provides the ability to increase the capacity and achieve favorable dehumidification in the cooling mode even when oversized.

Referring now to FIG. 8, in the heat pump heating mode, refrigerant is drawn by the compressor 10 from the condenser coil 11 via line 70, and through the heat pump reversing valve 30 and is suctioned via line 26. The refrigerant is discharged from the compressor 10 via line 24 through the heat pump reversing valve 30 which is positioned to direct the refrigerant via line 73 to the evaporator coil or indoor coil 13 providing positive heat augmentation in its air path temperature. The condensed refrigerant exits the indoor coil 13 via line 72 and passes through the first reversing valve 21 which directs it via line 40C through the second desiccant coil 20 and via line 40D to the second reversing valve 22 which is positioned to direct it via line 39 through the metering device or expansion valve 23 and via line 27 back through the second reversing valve 22 and via line 40B through the first desiccant coil 19 and back to the first reversing valve 21 which directs it via line 71 to the condenser coil or outdoor coil 11.

In the heat pump heating mode, the evaporator coil or indoor coil 13 serves as condenser coil and the desiccant coil 20 provides adiabatic cooling and its evaporative adiabatic effect provides humidification in the process air instead of the usual dehumidification effect. In this process the hottest refrigerant is first directed through the indoor coil 13 and heat is dissipated in the crossing process air stream, as previously described above in the condensing cycle of FIG. 5. After passing through the metering device or expansion valve 23, the refrigerant is conducted via line 27 to the second reversing valve 22, which directs it through line 40B to the desiccant coil 19.

The addition of water or humidification prior to introducing air to the desiccant coil results in favorable refrigeration performance and output of desirable indoor air for winter conditions. The added vapor then interchanges its energy to the desiccant coil and augments the refrigeration condensing cycle by providing an added adiabatic cooling effect to the regeneration process desiccant coil 20. This will augment humidification upon demand and simultaneously increase the refrigeration cycle capacity and energy performance. The lower humidity and temperature conditions of the entering air 1 provide a suitable environment for maximizing effective heat rejection energy transfer thereby augmenting the refrigeration cycle and compressor efficiency.

This arrangement also provides a very effective humidifier alternative. If the condensing conditions are lowered then it can enhance the total refrigeration cycle to be more efficient at lower outdoor conditions, which consequently increases operating time of the unit. However, from a degree-day analysis, the total output benefits of the present system significantly outweigh the increased operating time of the unit, as discussed below. Thus, due to its capacity to achieve favorable dehumidification in the cooling mode in proportion to its heat load and heating requirements enhances the operating capacity and eliminates the problems associated with heat pump oversizing.

The switching operation differs from the arrangement of FIGS. 1 and 2 in the reversing valve positioning and the reverse functions of the coils. Upon switching to a cross airflow mode of operation the first reversing valve 21 goes to a straight refrigerant flow path and the second reversing valve 22 goes to cross flow path. The switching is initiated upon the condition of the desiccant coil and its ability to continue to absorb heat energy from the crossing outside air stream. At this point, the coldest part of the system is the combined desiccant coil 19 and outdoor coil 11, and if the desiccant coil becomes frosted only a partial defrosting effect occurs at the desiccant coil 19, and this reduces the need to defrost the outdoor coil as often as in a conventional heat pump coil system. In a defrost cycle, the heat pump reversing valve 30 is positioned to the cooling mode and the condenser fan 12 starts cycling to enable defrosting.

One of the biggest limitations of an air heat pump application is not its energy performance, but the limitation that its coil, at lower outdoor temperature results in the accumulation of ice build up, and that the compressor performance decreases simultaneously as the outdoor temperature decreases and provides a reverse heat loss output effect.

The present desiccant coil design in a heat pump application provides significant advantages over a conventional coil due to its desiccant material, thickness, and storage quantities, and its resistance to damage by frost. In the present system the desiccant coil 19 is positioned downstream of the metering device or expansion valve 23. Thus, the condenser coil 11 has a diminished need for defrosting because the intake refrigerant is partially heated by the desiccant coil 19 thereby increasing its temperature and pressure conditions. It also compensates for drastic vapor-pressure and moisture content differences when switching between cold outdoor air and warm or hot indoor air, and enables the air heat pump to function at lower outdoor conditions.

It should be understood that the components of the various systems shown and described herein may be modified by re-arranging the components. For example, the heat exchange condensing unit 11 apparatus could be relocated in the line 39 rather than between lines 70 and 71. The heat exchange evaporator coil 13 could also be relocated in the intake air path 1, or in line 27, rather than between lines 73 and 72. The outdoor air heat exchanger may be replaced by a water type heat exchanger as discussed below with reference to FIG. 9A.

Figure 9A:
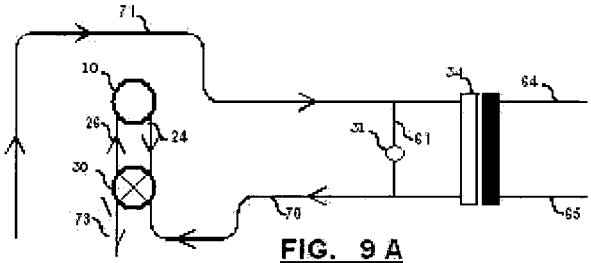
FIGS. 9A and 9B are partial diagrammatic views illustrating the components and refrigerant flow path of the air conditioning system in an alternate heat pump condenser and desiccant coil switching arrangement, respectively.

FIG. 9A is a schematic diagram showing a modification of a portion of the refrigerant path of a heat pump arrangement, similar to that shown in FIGS. 7 and 8, wherein the condenser 11 is replaced by a water-cooled heat exchanger 34 connected with water flow lines 64 and 65. The refrigerant flow path is shown in the heating mode, as shown in FIG. 8, wherein refrigerant is drawn by the compressor 10 from the condenser coil 11 via line 70, and through the heat pump reversing valve 30 and is suctioned via line 26, back to the suction side of the compressor 10. In this modification the refrigerant lines 70 and 71 are joined by a control line 61 containing a regulating device 31, which regulates the flow in response to the refrigerant pressure and temperature conditions. The refrigerant returns from the first reversing valve 21 (FIG. 8) via line 71 and is conducted either through bypass line 61 back to the reversing valve 30 or the heat exchanger 34, depending upon the refrigerant pressure and temperature conditions. The airflow path and remaining portion of the refrigeration path are the same as shown and described above with reference to FIGS. 7 and 8 and the same components and flow paths are assigned the same numerals of reference but will not be described again in detail to avoid repetition. This arrangement may be used for reheating domestic water, as a water source heat pump, a ground source heat pump or other application requiring water-cooled condensing.

Figure 9B:
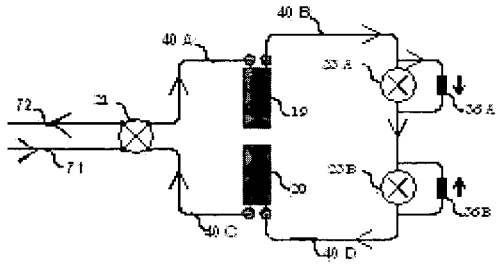

FIG. 9B is a schematic diagram showing another alternative modification of a portion of the refrigerant path a heat pump arrangement, similar to that shown in FIGS. 7 and 8, wherein the second reversing valve 22 is replaced by two metering devices or expansion valves 23A and 23B, each having a bypass line parallel therewith containing a check valve 36A and 36B, respectively. The check valves 36A and 36B operate in opposed relation to control the direction of refrigerant flow and facilitate switching of the desiccant coils.

The refrigerant path is shown in the cooling mode as in FIG. 7. During the switching operation, the refrigerant flows via line 71 to the first reversing valve 21, which directs it via line 40A through the first desiccant coil 19 and then via line 40B to the first metering device or expansion valve 23A, which is calibrated to stop the flow of refrigerant, and the refrigerant then bypasses through the first check valve 36A to flow through the second metering device or expansion valve 23B, whose bypass check valve 36B is closed to prevent the refrigerant from bypassing. After flowing through the second metering device or expansion valve 23B, the refrigerant flows via line 40D through the second desiccant coil 20 and then via line 40C back to the first reversing valve 21, which directs it via line 72 into the evaporator coil 13. It should be understood that the flow path would be reversed between cooling and heating modes, as described previously.

Figure 9C:
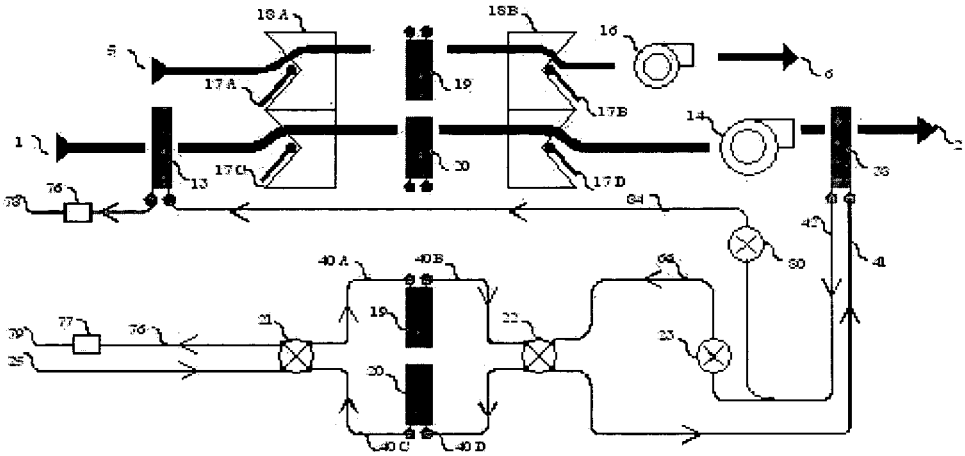
FIG. 9C is a diagrammatic view illustrating the components of the air conditioning system and flow paths in an alternate arrangement for augmenting dehumidification capacity, refrigerant temperature diversity, and coil reheating.

FIG. 9C is a partial diagrammatic view, similar to FIG. 6B, of a modification of the evaporator and parallel/series desiccant coil arrangement which augments dehumidification capacity, temperature diversity, and coil re-heating. This arrangement differs from FIG. 6B in that the evaporator coil 13 is located upstream from the process air blower or fan 14, and a reheat coil 38 (as in FIG. 6A) is disposed downstream from the process air blower or fan. The process air blower or fan 14 draws process air 1 across the evaporator coil 13 which cools the air, through the first damper assembly 18A, across the second desiccant coil 20 which provides dehumidification, through the second damper assembly 18B, and discharges it across the reheat coil 38 into the space to be conditioned 2. Alternatively, the mixed airflow path shown in FIG. 1 or FIG. 6A may be employed.

The refrigerant path is similar that shown in FIG. 6B. In this arrangement, the condensed refrigerant from the condenser 11 (shown in FIG. 1) flows through the liquid line 25 to the first reversing valve 21 which directs it via line 40A through the first desiccant coil 19, and then via line 40B to the second reversing valve 22. After passing through the second reversing valve 22, the refrigerant flows via line 41 through the reheat coil 38. Refrigerant exits the reheat coil 38 via line 42 and passes either through first metering device or expansion valve 23 and line 66 back to the second reversing valve 22, or flows via line 84 through the second metering device or expansion valve 80 into the evaporator coil 13, depending upon the control settings of the first and second metering devices or expansion valves 23 and 80. The refrigerant passing through the evaporator coil 13 flows through evaporator suction line 67 and an evaporator pressure regulator 76 and then through line 78 to any compressor or rack system. If the refrigerant is directed back to the second reversing valve 22, it flows via line 40D through the second desiccant coil 20 then via line 40C to the first reversing valve 21 which directs it via line 26 through an evaporator pressure regulator 77 then though line 79 to the suction side of the compressor or rack system.

The intake air 1 first crosses the evaporator coil 13 and is pre-conditioned prior to crossing the desiccant process coil 20, where it is dehumidified to a lower percentage of moisture and then is discharged through the re-heat coil 38. Optionally, the condenser fan 12 can be modulated to concentrate and transfer the rejected condensing energy to the re-heat coil 38. The air discharged into the space to be conditioned 2 is thus dehumidified and can either be cooled and/or re-heated.

This arrangement enhances effective desiccant drying by pre-conditioning its air vapor and temperature conditions, and maximizing the desiccant coil dehumidification. This arrangement simulates a typical residential refrigeration dehumidification unit but provides lower vapor-pressure conditions and more effective cooling and compressor efficiency. It should be understood that the evaporator coil 13 could be relocated and connected in series between the metering device or expansion valve 23 and the reversing valve 22 by lines 27 and 28, as shown in FIG. 1.

Figure 10:
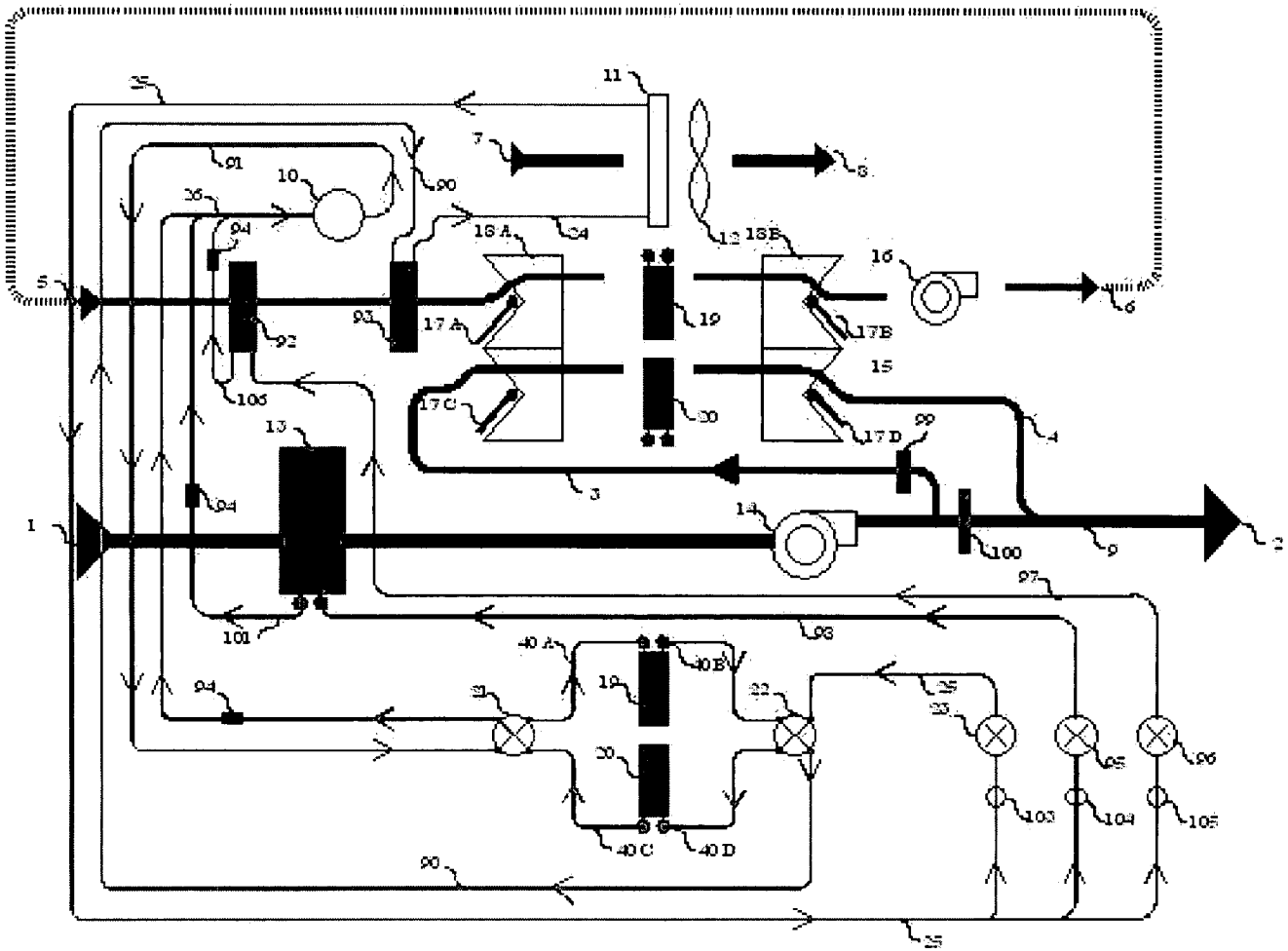
FIG. 10 is a diagrammatic view, somewhat similar to FIG. 1, illustrating an alternate embodiment of the system having an additional condenser and evaporator and showing the airflow and refrigeration path for routing the air and refrigerant through the coils in a straight flow mode of operation

FIG. 10 is a diagrammatic view, somewhat similar to FIG. 1, illustrating an alternate embodiment of the system having an additional condenser and evaporator and an alternate damper arrangement showing the airflow and refrigeration path for routing the air and refrigerant through the coils in a straight flow mode of operation. The same components and flow paths described previously are assigned the same numerals of reference but will not be described again in detail to avoid repetition. In this arrangement, the evaporator coil 13 is located upstream from the process air blower or fan 14, and the process air blower or fan 14 draws process air 1 across the evaporator coil 13, as described previously. A pair of dampers 99 and 100 are disposed downstream from the fan 14 in the discharged air path and cooperate to modulate or selectively direct a portion of discharged supply air 9 from the evaporator coil 13 through the first damper assembly 18A as desiccant process air 3, across the second desiccant coil 20, and through the damper assembly 18B which then passes as desiccant process discharge air 4 back into the supply air 9 which is conducted into the space to be conditioned 2.

A regeneration evaporator 92 and a regeneration condenser 93 are disposed downstream from the regeneration air fan 16. The regeneration fan 16 draws regeneration air 5 across the evaporator coil 92, across the regeneration condenser 93, through the first damper assembly 18A, across the first desiccant coil 19, through the second damper assembly 18B, and discharges it as regeneration air exhaust 6 to the outdoors. Alternatively, as shown in dashed line, the regeneration air exhaust 6 may be redirected in a loop back to the regeneration intake air 5 when adequate conditioned regeneration air is not available.

In the cooling mode, the compressor 10 discharges superheated refrigerant via line 91 to the first reversing valve 21 which directs it via line 40A through the first desiccant coil 19, and then via line 40B to the second reversing valve 22, which directs it via line 90 through the regeneration condenser 93, and it exits the regeneration condenser 93 via line 24 to the condenser 11. Refrigerant from the condenser 11 flows through the liquid line 25, a first solenoid valve 103, a first metering device or expansion valve 23 and back to the second reversing valve 22. A first bypass line 98 adjoined to line 25 upstream from the solenoid valve 103 extends to the evaporator coil 13 and contains a second solenoid valve 104, and a second metering device or expansion valve 95. A second bypass line 97 adjoined to line 98 upstream from the solenoid valve 104 extends to the regeneration evaporator 92 and contains a third solenoid valve 105, and a third metering device or expansion valve 96. Thus, depending upon the settings of the solenoid valves, the refrigerant can be selectively directed back to the second reversing valve 22, to the evaporator coil 13, to the regeneration evaporator 92, or to all simultaneously, or to selected combinations.

If the refrigerant is directed back to the second reversing valve 22, it flows via line 40D through the second desiccant coil 20 then via line 40C to the first reversing valve 21, which directs it via line 26 through a pressure regulator 94 to the suction side of the compressor 10. If the refrigerant is directed to the evaporator coil 13, it passes through the evaporator coil and via line 101 through a pressure regulator 94 to the suction side of the compressor 10. If the refrigerant is directed to the regeneration evaporator 92, it passes through the regeneration evaporator coil and via line 106 through a pressure regulator 94 to the suction side of the compressor 10.

The hottest refrigerant travels first to the desiccant coil 19, then to the regeneration condenser 93, and then to the condenser coil 11. The condenser fan 12 can be selectively modulated to transfer the refrigerant energy capacity and concentrate it in the other series connected condensers if necessary to either accelerate the desiccant drying or heat the regeneration air.

This arrangement differs from the previous embodiments in that the intake regeneration air 5 can optionally be cooled first to initially reach a lower outdoor dew point condition. Then the air can be re-heated through the regeneration air condenser 93. This option provides enhanced entering air humidity conditions prior to the desiccant regeneration coil 19 and the regeneration process provides enhanced drying capability to assure dehumidification.

If the regeneration air exhaust 6 is redirected in a loop back to the regeneration air 5 intake, as shown in dashed line, it can facilitate desiccant drying and regeneration. This could be used if there is insufficient or inadequate regeneration air available. The drain pan of the regeneration evaporator 92 could accumulate moisture if needed. The adiabatic cooling of the regeneration desiccant coil 19 provides humidified condenser cooled air at the regeneration exhaust air 6. That saturated air is redirected to the intake regeneration air 5 and the regeneration evaporator coil 94 removes the moisture content without having first to decrease the sensible energy to reach a typical dew point to provide effective dehumidification. This arrangement provides a system capable of selectively shifting or transferring the refrigerant to various coils to absorb heat energy and provide different delivery air output depending upon the particular requirements and is designed to accommodate situations in which the regeneration air intake is not favorable.

Figure 11A:
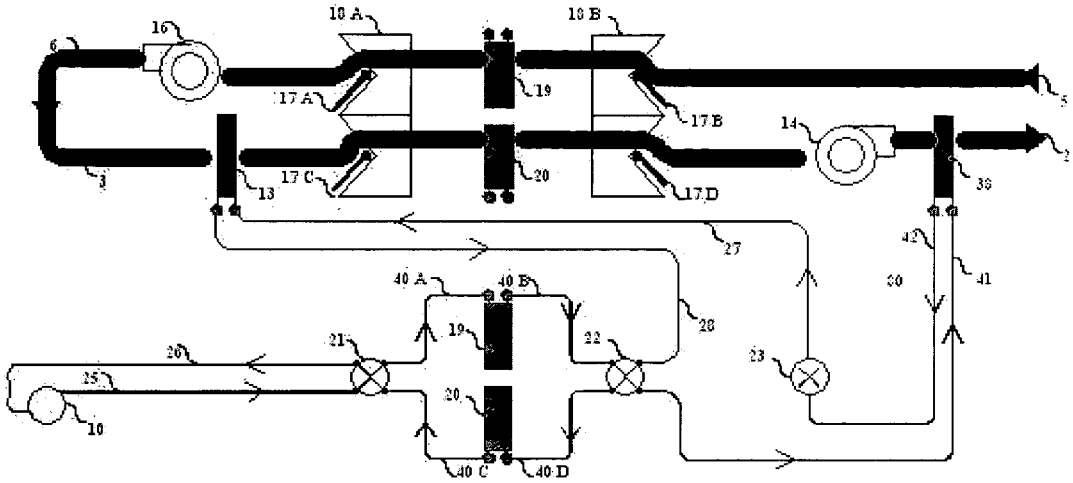
FIG. 11A is a diagrammatic view, somewhat similar to FIG. 9C, illustrating the components of the system showing an alternate path for routing the air and refrigerant through the coils in a straight flow mode of operation to enhance dehumidification.

FIG. 11A is a partial diagrammatic view, similar to FIG. 9C, of a modification of the system showing the refrigeration path for routing the air and refrigerant through the coils in a straight flow mode of operation wherein the outdoor condenser 11 has been eliminated. The same components and flow paths described previously are assigned the same numerals of reference but will not be described again in detail to avoid repetition. In this arrangement the regeneration air intake 5, which could be from the conditioned space or outdoors, is drawn by the regeneration air fan 16 through the damper assemblies 18A and 18B, across the regeneration desiccant coil 19 and exhausted as regeneration air exhaust 6 which is saturated and slightly elevated in temperature. This saturated air is redirected to the intake of the desiccant process air 3, and is drawn by the process air blower or fan 14 across the evaporator coil 13, through the damper assemblies 18A and 18B, across the process desiccant coil 20 and exhausted across the condenser reheat coil 38 into the space to be conditioned 2. The process desiccant coil 20 attracts the moisture and dehumidifies the air leaving the coil. The air is reheated by the condenser reheat coil 38 prior to being exhausted into the space 2 or outdoors. The refrigeration cooling process, already at saturation, removes moisture as result without having to reach the dew point that occurs in a conventional process where cooling energy brings the air to saturation before any dehumidification can occur. The air is then dehumidified and cooled.

Thus, a novel feature in this arrangement is that the air is saturated first before crossing the evaporator coil 13 and then it is dried. This sequence enables the evaporator to remove the desiccant by a de-sorption process and the system provides dehumidified air. This arrangement may also be used as a water liquefier, meaning a unit capable of accumulating water from the cooling process or from the evaporator drain, or may be used as a simple dehumidifier.

As with the previous embodiments, the refrigerant path and the direction of the air stream across the desiccant coils may be switched between the cross airflow and the straight airflow and vice versa, as depicted in FIGS. 1 and 2.

Figure 11B:
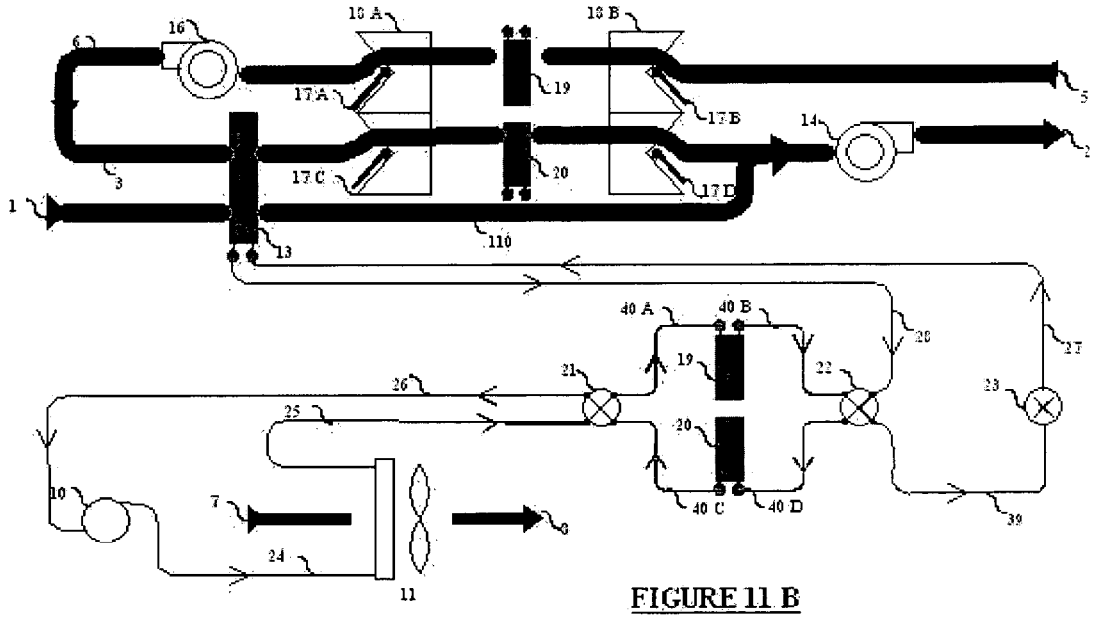
FIG. 11B is a diagrammatic view, somewhat similar to FIG. 11A, illustrating the components of the system showing an alternate path for routing the air and refrigerant through the coils in a straight flow mode of operation to enhance dehumidification and cooling.

FIG. 11B is a diagrammatic view of a modification of the embodiment of FIG. 11A, and the same components and flow paths described previously are assigned the same numerals of reference but will not be described again in detail to avoid repetition. This modification differs from FIG. 11A in that the condenser reheating coil 38 system is eliminated, the condenser 11 provides for part of the refrigerant heat dissipation, and the process air blower or fan 14 also draws process air 1 across the evaporator coil 13 the air in a bypass path 110 isolated from the damper assemblies and it is mixed with the regeneration exhaust air 6 and desiccant process air 3 after the desiccant process and the combined air is then exhausted to the space to be conditioned 2.

In this arrangement, the evaporator coil 13 removes all of the moisture content from the process air 1 and the process desiccant coil 20 removes the moisture from the combined regeneration exhaust air 6 and desiccant process air 3, and when the refrigerant flow through the coil 20 is switched it reintroduces that moisture to aid the evaporator coil 13 in removing it by saturating its entering air.

As with the previous embodiments, the refrigerant path and the direction of the air stream across the desiccant coils may be switched between the cross airflow and the straight airflow and vice versa, as depicted in FIGS. 1 and 2.

While this invention has been described fully and completely with special emphasis upon preferred embodiments, it should be understood that within the scope of the appended claims the invention may be practiced otherwise than as specifically described herein.

The invention claimed is:

1. A desiccant-assisted air conditioning and dehumidification/humidification system, comprising:

a refrigeration circuit including a refrigerant compressor, an evaporator coil, and a condenser coil connected in series in a refrigerant flow path, a condenser fan that draws outdoor air through the condenser coil and exhausts it back to the outdoors, and a process fan that draws process air through the evaporator coil and discharges it as supply air into a space to be conditioned;

a supplemental dehumidification/humidification system including a first desiccant coil and a second desiccant coil in said refrigerant flow path, each having desiccant material thereon, first valve means disposed in the refrigerant flow path for controlling flow of refrigerant between said desiccant coils and said compressor and said condenser coil, second valve means disposed in the refrigerant flow path for controlling flow of refrigerant between said desiccant coils and said evaporator coil, and refrigerant metering means disposed in the refrigerant flow path between said second valve means and said evaporator coil for reducing the temperature and pressure of refrigerant flowing therethrough; and air conveyance means for directing a regeneration air stream through said first desiccant coil and exhausting it, and directing a portion of the supply air discharged by said process fan in a desiccant process air stream through said second desiccant coil and exhausting it back into the supply air which is discharged into the space to be conditioned; wherein in a first mode of operation, said first desiccant coil receives condensed refrigerant from said condenser coil and the regeneration air stream passing therethrough further cools and condenses the refrigerant with the rejected heat of said condensation concurrently drying the desiccant material on the first desiccant coil and the thus cooled and condensed refrigerant passes through said refrigerant metering means which further reduces the temperature and pressure of refrigerant flowing therethrough and the evaporator coil receives the lower temperature and pressure refrigerant which absorbs heat from the process air stream passing therethrough and the heated refrigerant passing therethrough; and said second desiccant coil receives heated refrigerant from said evaporator coil and the desiccant material on the second desiccant coil concurrently absorbs moisture from the desiccant process air stream passing therethrough and further heats the refrigerant passing therethrough with the thus dryer desiccant process air stream discharged back into the supply air and the further heated refrigerant is suctioned to said compressor and discharged into the condenser coil;

in a second mode of operation, said first and second valve means and said air conveyance means are positioned such that said regeneration air stream is directed through said second desiccant coil and exhausted, and said desiccant process air stream is directed through said first desiccant coil and exhausted it back into the supply air;

said previously moistened second desiccant coil receives condensed refrigerant from said condenser coil and the regeneration air stream passing therethrough further cools and condenses the refrigerant with the rejected heat of said condensation concurrently drying said desiccant material and the thus cooled and condensed refrigerant passes through said refrigerant metering means which further reduces the temperature and pressure of refrigerant flowing therethrough and the evaporator coil receives the lower temperature and pressure refrigerant which absorbs heat from the process air stream passing therethrough and the heated refrigerant; and said previously dried first desiccant coil receives heated refrigerant from said evaporator coil and the desiccant material on the first coil concurrently absorbs moisture from the desiccant process air stream passing therethrough and further heats the refrigerant passing therethrough with the thus dryer desiccant process air stream discharged back into the supply air and the further heated refrigerant is suctioned to said compressor and discharged into the condenser coil.

2. The desiccant-assisted air conditioning and dehumidification/humidification system according to claim 1, further comprising:

a condenser reheat coil in said refrigerant flow path connected in series between said condenser coil and said first valve means and disposed downstream from said process fan and through which said supply air stream passes prior to being discharged into the space to be conditioned; and in said first mode of operation, condensed refrigerant from said condenser coil first passes through said condenser reheat coil and is cooled and condensed by the supply air and concurrent therewith the supply air is heated with the rejected heat of condensation, then the cooled and condensed refrigerant is received by said first desiccant coil, and thereafter continues in the refrigerant flow path as recited in claim 1.

3. The desiccant-assisted air conditioning and dehumidification/humidification system according to claim 1, further comprising:

an alternate refrigerant bypass flow path extending between said refrigerant metering means and said second valve means, first pressure regulator means in said refrigerant flow path downstream from said evaporator coil, and second pressure regulator means in said refrigerant flow path downstream from said second desiccant coil; and in said first mode, depending upon the refrigerant pressure and pressure setting of said first and second pressure regulator means, the refrigerant after passing through said refrigerant metering means flows either through said evaporator coil then passes through the first pressure regulator means and back to said compressor as recited in claim 1, or through said bypass flow path and through said second desiccant coil then passes through said second pressure regulator means and back to said compressor as recited in claim 1, or passes proportionally through both said evaporator coil and said second desiccant coil then through said first and second pressure regulator means, respectively, to said compressor; thereby concentrating refrigeration absorption energy to either said evaporator coil or said second desiccant coil or to both to provide desired supply air and process air output conditions.

4. A desiccant-assisted air conditioning and dehumidification/humidification system, comprising:

a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

a supplemental dehumidification/humidification system including a first desiccant coil and a second desiccant coil in said refrigerant flow path, each having desiccant material thereon, said first desiccant coil connected in series between said compressor and said condenser coil, first valve means disposed in the refrigerant flow path for controlling flow of refrigerant between said desiccant coils and said compressor and said evaporator coil, second valve means for controlling flow of refrigerant between said desiccant coils and said condenser coil, and refrigerant metering means disposed in the refrigerant flow path between said second valve means and said condenser coil for reducing the temperature and pressure of refrigerant flowing therethrough; and air conveyance means for directing a regeneration air stream through said first desiccant coil and exhausting it, and directing a portion of the supply air discharged by said process fan in a desiccant process air stream through said second desiccant coil and exhausting it back into the supply air which passes into the space to be conditioned; wherein in a first mode of operation, said first desiccant coil receives hot refrigerant discharged from said compressor and the regeneration air stream passing therethrough cools and condenses the refrigerant with the rejected heat of said condensation concurrently drying the desiccant material on the first desiccant coil and the thus cooled and condensed refrigerant passes through said condenser coil which further cools and condenses the refrigerant and the thus cooled and condensed refrigerant from the condenser coil passes through said refrigerant metering means which further reduces the temperature and pressure of refrigerant flowing therethrough; and the lower temperature and pressure refrigerant passes through said second desiccant coil and the desiccant material on the second desiccant coil concurrently absorbs moisture from the desiccant process air stream passing therethrough and heats the refrigerant passing therethrough with the thus dryer desiccant process air stream discharged back into the supply air and said evaporator coil receives the heated refrigerant which absorbs heat from the process air stream passing therethrough and the further heated refrigerant is suctioned to said compressor.

5. A desiccant-assisted air conditioning and dehumidification/humidification system, comprising:

a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

a supplemental dehumidification/humidification system including a first desiccant coil and a second desiccant coil in said refrigerant flow path, each having desiccant material thereon, first valve means disposed in the refrigerant flow path for controlling flow of refrigerant between said desiccant coils and said compressor and said condenser coil, second valve means disposed in the refrigerant flow path for controlling flow of refrigerant between said desiccant coils and said evaporator coil, first refrigerant metering means disposed in the refrigerant flow path between said second valve means and said evaporator coil, an alternate refrigerant bypass flow path extending between said second valve means and said first refrigerant metering means and said second valve means, and a second refrigerant metering means in said bypass flow path, a first pressure regulator in said refrigerant flow path downstream from said evaporator coil, and a second pressure regulator in said refrigerant flow path downstream from said second desiccant coil; and air conveyance means for directing a regeneration air stream through said first desiccant coil and exhausting it, and directing process air drawn by said process fan through said second desiccant coil and through said evaporator coil prior to being discharged as supply air into the space to be conditioned; wherein in a first mode of operation, said first desiccant coil receives condensed refrigerant from said condenser coil and the regeneration air stream passing therethrough further cools and condenses the refrigerant with the rejected heat of said condensation concurrently drying the desiccant material on the first desiccant coil, and then;

depending upon the control settings of said first and second pressure regulators and said first and second refrigerant metering means, the thus cooled and condensed refrigerant flows either through the first refrigerant metering means, which further reduces the temperature and pressure of the refrigerant flowing therethrough, and then passes through said evaporator coil where the lower temperature and pressure refrigerant absorbs heat from the process air stream passing therethrough and the heated refrigerant passes through said first pressure regular and to the suction side of said compressor; or the cooled and condensed refrigerant from said first desiccant coil flows through said second pressure regular, which further reduces the temperature and pressure of the refrigerant flowing therethrough, and then passes through said second desiccant coil and the desiccant material on the second desiccant coil concurrently absorbs moisture from the process air stream passing therethrough and heats the refrigerant passing therethrough, the heated refrigerant then being suctioned to said compressor and the dryer process air stream then discharged through said evaporator coil as supply air into the space to be conditioned.

6. A desiccant-assisted heat pump air conditioning and dehumidification/humidification system, comprising:

a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

a supplemental dehumidification/humidification system including a first desiccant coil and a second desiccant coil in said refrigerant flow path, each having desiccant material thereon, first valve means disposed in the refrigerant flow path for controlling flow of refrigerant between said desiccant coils and said compressor and said condenser coil, second valve means disposed in the refrigerant flow path for controlling flow of refrigerant between said desiccant coils and said evaporator coil, refrigerant metering means disposed in the refrigerant flow path connected with said second valve means;

air conveyance means for directing a regeneration air stream through said first desiccant coil and exhausting it, and directing a portion of the supply air discharged by said process fan in a desiccant process air stream through said second desiccant coil and exhausting it back into the supply air which passes through the evaporator coil and into the space to be conditioned; and third valve means in said refrigerant flow path and connected with said compressor for selectively controlling the direction of the flow of refrigerant to and from said compressor; wherein in a cooling mode of operation, said first desiccant coil receives condensed refrigerant from said condenser coil and the regeneration air stream passing therethrough further cools and condenses the refrigerant with the rejected heat of said condensation concurrently drying the desiccant material on said first desiccant coil, and the thus cooled and condensed refrigerant flows through said refrigerant metering means, which further reduces the temperature and pressure of the refrigerant flowing therethrough, passes through said second desiccant coil and the desiccant material on the second desiccant coil concurrently absorbs moisture from the desiccant process air stream passing therethrough and heats the refrigerant passing therethrough, and the heated refrigerant passes through said evaporator coil where it absorbs heat from the desiccant process air stream passing therethrough, the heated refrigerant then being suctioned to said compressor and discharged back to the condenser coil and the dryer desiccant process air stream is mixed with the supply air and discharged through said evaporator coil into the space to be conditioned; and in a heating mode of operation, refrigerant is drawn from said condenser by said compressor which increases the temperature and pressure of the refrigerant and it is discharged through said evaporator coil where the refrigerant heat is dissipated into the process air stream passing therethrough and the refrigerant is cooled and condensed, the cooled and condensed refrigerant then passes through said second desiccant coil and the desiccant material of the second desiccant coil in a desorption process concurrently humidifies the desiccant process air stream passing therethrough and cools the refrigerant passing therethrough, the cooled refrigerant then flows through said refrigerant metering means, which reduces the temperature and pressure of the refrigerant flowing therethrough, and passes through said first desiccant coil where the desiccant material of said first desiccant coil in a sorption process concurrently adsorbs heat from the regeneration air stream passing therethrough and heats the refrigerant passing therethrough, the heated refrigerant then flows back into the condenser coil, and the moist desiccant process air stream exiting the second desiccant coil is mixed back into the supply air stream and passes through the evaporator coil and into the space to be conditioned.

7. The desiccant-assisted heat pump air conditioning and dehumidification/humidification system according to claim 6, further comprising:

a regulating means is disposed in said refrigerant flow path parallel with said condenser for regulating refrigerant flow in response to the refrigerant pressure and temperature conditions; and in said heating mode, depending upon the refrigerant pressure and temperature conditions, the refrigerant passing through said first desiccant coil is directed back into said condenser, or is returned by said compressor and said third valve means back through said evaporator coil, thereby bypassing entry into said condenser until predetermined refrigerant pressure and temperature conditions are achieved.

8. The desiccant-assisted heat pump air conditioning and dehumidification/humidification system according to claim 6, wherein said second valve means comprises a first and a second refrigerant metering means disposed in series in the refrigerant flow path and connected in parallel with said first and said desiccant coils, and said first and second refrigerant metering means each having a bypass line containing a first and second check valve connected in parallel therewith, respectively, and each of said check valves operating in opposed relation to control the direction of refrigerant flow, said first and second refrigerant metering means being calibrated to only allow flow of refrigerant of respective different temperature and pressure conditions therethrough; such that in said cooling mode, the cooled and condensed refrigerant after passing through said first desiccant coil bypasses said first refrigerant metering means, passes through said first check valve and then passes through said second refrigerant metering means and into said second desiccant coil and thereafter continues in the refrigerant flow path as recited in the cooling mode of claim 6; and in said heating mode, the heated refrigerant after passing through said second desiccant coil bypasses said second refrigerant metering means, passes through said second check valve and then passes through said first refrigerant metering means and into said first desiccant coil and thereafter continues in the refrigerant flow path as recited in the heating mode of claim 6.

9. A desiccant-assisted air conditioning and dehumidification/humidification system, comprising:

a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

a supplemental dehumidification/humidification system including a first desiccant coil and a second desiccant coil in said refrigerant flow path, each having desiccant material thereon, first valve means disposed in the refrigerant flow path for controlling flow of refrigerant between said desiccant coils and said compressor and said condenser coil, second valve means disposed in the refrigerant flow path for controlling flow of refrigerant between said desiccant coils and said evaporator coil, and a condenser reheat coil in said refrigerant flow path disposed downstream from said process fan;

a first refrigerant bypass flow line connecting said reheat coil with said evaporator coil, and a first refrigerant metering means disposed in said first refrigerant bypass flow line, a second refrigerant bypass flow line adjoined to said first refrigerant bypass flow line between said first refrigerant metering means and extending to said second valve means, and a second refrigerant metering means in said second refrigerant bypass flow line, a first pressure regulator means in said refrigerant flow path downstream from said evaporator coil, and a second pressure regulator means in said refrigerant flow path downstream from said second desiccant coil;

air conveyance means for directing a regeneration air stream through said first desiccant coil and exhausting it, and directing process air drawn by said process fan through said evaporator coil, said second desiccant coil, and then through said condenser reheat coil prior to being discharged as supply air into the space to be conditioned; wherein in a first mode of operation (straight flow), refrigerant from said condenser coil first passes through said first desiccant coil and the regeneration air stream passing therethrough cools and condenses the refrigerant with the rejected heat of said condensation concurrently drying the desiccant material of the first desiccant coil, and then the condensed refrigerant passes through said condenser reheat coil and is further cooled and condensed by the process air stream passing therethrough and concurrent therewith the process air is heated with the rejected heat of condensation;

then, depending upon the control settings of said first and second pressure regulator means and said first and second refrigerant metering means, the thus cooled and condensed refrigerant flows either through said first refrigerant metering means, which further reduces the temperature and pressure of the refrigerant flowing therethrough, and then passes through said evaporator coil where the lower temperature and pressure refrigerant absorbs heat from the process air stream passing therethrough and the heated refrigerant passes through said first pressure regular to the suction side of said compressor; or the cooled and condensed refrigerant from said reheat coil flows through said second refrigerant metering means, which further reduces the temperature and pressure of the refrigerant flowing therethrough, and then passes through said second desiccant coil and the desiccant material of the second desiccant coil concurrently absorbs moisture from the process air stream passing therethrough and heats the refrigerant passing therethrough, and the heated refrigerant passes through said second pressure regulator means to the suction side of said compressor.

10. A desiccant-assisted air conditioning and dehumidification/humidification system, comprising:

a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

a supplemental dehumidification/humidification system including a first desiccant coil and a second desiccant coil in said refrigerant flow path, each having desiccant material thereon, said first desiccant coil connected in series between said compressor and said condenser coil, first valve means disposed in the refrigerant flow path for controlling flow of refrigerant between said desiccant coils and said compressor and said evaporator coil, first pressure regulator means in said refrigerant flow path between said first valve means and the suction side of said compressor, second valve means for controlling flow of refrigerant between said desiccant coils and said condenser coil, a first solenoid valve and a first refrigerant metering means connected in series between said condenser coil and said second valve means, a regeneration condenser coil in said refrigerant flow path disposed between said second valve means and said condenser coil, a first bypass line adjoined between said condenser coil and said first solenoid valve and extending to said evaporator coil, a second solenoid valve and a second refrigerant metering means in said first bypass line, a second pressure regulator means disposed between said evaporator coil and the suction side of said compressor, a second bypass line between said condenser coil and the suction side of said compressor, a fourth solenoid valve, a third refrigerant metering means, a regeneration evaporator coil, and a third pressure regulator means disposed in series in said second bypass line, said regeneration evaporator coil disposed in said regeneration air stream upstream from said regeneration condenser coil;

air conveyance means for directing a regeneration air stream through said regeneration evaporator coil, said regeneration condenser coil, said first desiccant coil and then exhausting it, and directing a portion of the supply air discharged by said process fan in a desiccant process air stream through said second desiccant coil and exhausting it back into the supply air which passes into the space to be conditioned; wherein in a cooling mode of operation, depending upon the demand and/or settings of said solenoid valves, the refrigerant is selectively directed back to said compressor, to said evaporator coil, or to said regeneration evaporator coil, or to all simultaneously, or to selected combinations thereof.

11. The desiccant-assisted air conditioning and dehumidification/humidification system according to claim 10, wherein:

in a first flow path, said first desiccant coil receives superheated refrigerant discharged from said compressor and the regeneration air stream passes through said regeneration evaporator coil, through said regeneration condenser coil, through said first desiccant coil, and is exhausted, said first desiccant coil cools and condenses the refrigerant with the rejected heat of said condensation concurrently drying the desiccant material of said first desiccant coil and the thus cooled and condensed refrigerant passes through said regeneration condenser coil, and through said condenser coil which further cools and condenses the refrigerant and the thus cooled and condensed refrigerant from the condenser coil passes through said first solenoid valve and said first refrigerant metering means which further reduces the temperature and pressure of refrigerant flowing therethrough; and the lower temperature and pressure refrigerant passes through said second desiccant coil and the desiccant material on the second desiccant coil concurrently absorbs moisture from the desiccant process air stream passing therethrough and heats the refrigerant passing therethrough with the thus dryer desiccant process air stream discharged back into the supply air and the heated refrigerant passes through said first pressure regulator means and back to the suction side of the compressor;

in a second flow path, refrigerant from said condenser coil passes through said second solenoid valve and said second refrigerant metering means which reduces the temperature and pressure of refrigerant flowing therethrough, and through said evaporator coil where the lower temperature and pressure refrigerant absorbs heat from the process air stream passing therethrough and the heated refrigerant passes through said second pressure regulator means to the suction side of said compressor; and in a third flow path, refrigerant from said condenser coil passes through said third solenoid valve and said third refrigerant metering means which reduces the temperature and pressure of refrigerant flowing therethrough, and through said regeneration evaporator coil where the lower temperature and pressure refrigerant absorbs heat from the desiccant process air stream passing therethrough and the heated refrigerant passes through said third pressure regulator means to the suction side of said compressor; and in a combined flow path, refrigerant flows selectively through any or all of said flow paths, depending upon the demand.

12. The desiccant-assisted air conditioning and dehumidification/humidification system according to claim 10, wherein:

said exhausted regeneration air stream after passing through said first desiccant coil is directed back through said regeneration evaporator coil, through said regeneration condenser coil, and through said first desiccant coil, in an endless loop.

13. A desiccant-assisted air conditioning and dehumidification/humidification system, comprising:

a refrigeration circuit including a refrigerant compressor, an evaporator coil, and a condenser reheat coil connected in a refrigerant flow path, a process fan, and a regeneration fan;

a first desiccant coil and a second desiccant coil in said refrigerant flow path, each having desiccant material thereon, first valve means disposed in the refrigerant flow path for controlling flow of refrigerant between said desiccant coils and said compressor and second valve means disposed in the refrigerant flow path for controlling flow of refrigerant between said desiccant coils and said evaporator coil and said condenser reheat coil, a refrigerant flow line connecting said reheat coil with said evaporator coil, and a refrigerant metering means disposed in said refrigerant flow line;

said evaporator coil disposed upstream from said first desiccant coil, and said condenser reheat coil disposed downstream from said second desiccant coil;

air conveyance means for directing a regeneration air stream drawn by said regeneration fan through said first desiccant coil and exhausting it as desiccant process air, and directing desiccant process air drawn by said process fan through said evaporator coil, said second desiccant coil, and then through said condenser reheat coil prior to being discharged as supply air into the space to be conditioned; wherein in a cooling mode of operation, refrigerant is discharged from said compressor and passes through first desiccant coil and the regeneration air stream passing therethrough cools and condenses the refrigerant with the rejected heat of said condensation concurrently drying the desiccant material of said first desiccant coil, and the condensed refrigerant passes through said condenser reheat coil and is further cooled and condensed by the desiccant process air stream passing therethrough, then the thus cooled and condensed refrigerant flows through said refrigerant metering means, which further reduces the temperature and pressure of the refrigerant flowing therethrough, and passes through said evaporator coil where the lower temperature and pressure refrigerant absorbs heat from the desiccant process air stream passing therethrough, then the cooled and condensed refrigerant passes through said second desiccant coil and the desiccant material of the second desiccant coil concurrently absorbs moisture from and dehumidifies the desiccant process air stream passing therethrough and heats the refrigerant passing therethrough, and the heated refrigerant passes to the suction side of said compressor.

14. A desiccant-assisted air conditioning and dehumidification/humidification system, comprising:

a refrigeration circuit including a refrigerant compressor, an evaporator coil, and a condenser coil connected in a refrigerant flow path, a condenser fan that draws outdoor air through the condenser coil and exhausts it back to the outdoors, a process fan, and a regeneration fan;

a first desiccant coil and a second desiccant coil in said refrigerant flow path, each having desiccant material thereon, first valve means disposed in the refrigerant flow path for controlling flow of refrigerant between said desiccant coils, said compressor, and said condenser coil, and second valve means disposed in the refrigerant flow path for controlling flow of refrigerant between said desiccant coils and said evaporator coil, and a refrigerant metering means disposed in said refrigerant flow line between said second valve means and said evaporator coil;

said evaporator coil disposed upstream from said first desiccant coil;

air conveyance means for directing a regeneration air stream drawn by said regeneration fan through said first desiccant coil and exhausting it as desiccant process air, and directing desiccant process air drawn by said process fan through said evaporator coil, said second desiccant coil, and discharging it as supply air into the space to be conditioned; wherein in a cooling mode of operation, hot refrigerant is discharged from said compressor and passes through said condenser coil and the outdoor air passing therethrough cools and condenses it and it passes through said first desiccant coil and the regeneration air stream passing therethrough further cools and condenses the refrigerant with the rejected heat of said condensation concurrently drying the desiccant material of said first desiccant coil, then the thus cooled and condensed refrigerant flows through said refrigerant metering means, which further reduces the temperature and pressure of the refrigerant flowing therethrough, and passes through said evaporator coil where the lower temperature and pressure refrigerant absorbs heat from the desiccant process air stream passing therethrough, then the cooled and condensed refrigerant passes through said second desiccant coil and the desiccant material of the second desiccant coil concurrently absorbs moisture from and dehumidifies the desiccant process air stream passing therethrough and heats the refrigerant passing therethrough, and the heated refrigerant passes to the suction side of said compressor; and said process fan also draws process air through said evaporator coil in a bypass process air stream isolated from said desiccant process air stream and it is mixed with the desiccant process air stream downstream from said second desiccant coil and the combined air is then exhausted to the space to be conditioned.

15. A desiccant-assisted air conditioning process for conditioning a space, comprising the steps of:

providing a compressor, and a condenser coil connected in a refrigerant flow path;

providing first and second heat exchanging desiccant coils connected in heat exchange relation with a selected refrigerant flow path, each having desiccant material thereon disposed for thermal contact with a selected air flow stream;

providing an evaporator coil in the refrigerant flow path connected with said first and second desiccant coils, and routing a process air stream through the evaporator coil and discharging it as supply air into the space to be conditioned; and in a first mode of operation;

routing condensed refrigerant from said condenser through said first desiccant coil, and routing a regeneration air flow stream through said first desiccant coil to further condense and cool the refrigerant passing therethrough with the rejected heat resulting from said condensation and simultaneously regenerating (drying) the desiccant material of said first desiccant coil;

routing the cooled and condensed refrigerant from said first desiccant coil through refrigerant metering means to further reduce the temperature and pressure of the refrigerant flowing therethrough and then passing the lower temperature and pressure through the evaporator coil where the lower temperature and pressure refrigerant absorbs heat from the process air stream passing therethrough and the heated refrigerant passing therethrough;

routing the thus condensed and cooled refrigerant from said evaporator coil through said second desiccant coil, and routing a portion of the discharged supply air in a desiccant process air stream through said second desiccant coil to heat the refrigerant passing therethrough with the desiccant material of said second desiccant coil concurrently absorbing moisture from the desiccant process air stream passing therethrough thereby dehumidifying and cooling the desiccant process air stream which is then exhausted back into the supply air which is discharged into the space to be conditioned; and routing heated refrigerant from said second desiccant coil to said compressor which discharges it into said condenser coil; and in a second mode of operation;

routing said regeneration air stream through said second desiccant coil and exhausting it;

routing said desiccant process air stream through said first desiccant coil and exhausting it back into said supply air;

routing condensed refrigerant from said condenser through said previously moistened second desiccant coil and routing the regeneration air stream passing therethrough to cool and condense the refrigerant with the rejected heat of said condensation concurrently drying said desiccant material of said second desiccant coil and routing the thus cooled and condensed refrigerant through refrigerant metering means to further reduces the temperature and pressure of refrigerant flowing therethrough and routing lower temperature and pressure refrigerant to said evaporator coil where it absorbs heat from the process air stream passing therethrough and the heated refrigerant passing therethrough; and routing heated refrigerant from said evaporator coil to said previously dried first desiccant coil where the desiccant material of the first desiccant coil concurrently absorbs moisture from the desiccant process air stream passing therethrough thereby dehumidifying the desiccant process air stream and further heating the refrigerant passing therethrough with the thus dryer desiccant process air stream discharged back into the supply air and the further heated refrigerant is returned to said compressor which discharges it into the condenser coil.

16. The process according to claim 15, comprising the further steps of:

providing a condenser reheat coil in said refrigerant flow path connected in series between said condenser coil and said first valve means through which said supply air stream passes prior to being discharged into the space to be conditioned; and in said first mode of operation, first passing the condensed refrigerant from said condenser coil through said condenser reheat coil to be cooled and condensed by the supply air and concurrent therewith heating the supply air with the rejected heat of condensation, then passing the cooled and condensed refrigerant into said first desiccant coil, and thereafter continuing the refrigerant flow path as recited in claim 15.

17. The process according to claim 15, comprising the further steps of::

providing an alternate refrigerant bypass flow path including first pressure regulator means in said refrigerant flow path downstream from said evaporator coil, and second pressure regulator means in said refrigerant flow path downstream from said second desiccant coil; and in said first mode, depending upon the refrigerant pressure and pressure setting of said first and second pressure regulator means, the refrigerant after passing through said refrigerant metering means flows either through said evaporator coil then passes through the first pressure regulator means and back to said compressor as recited in claim 15, or through said bypass flow path and through said second desiccant coil then passes through said second pressure regulator means and back to said compressor as recited in claim 15, or passes proportionally through both said evaporator coil and said second desiccant coil then through said first and second pressure regulator means, respectively, to said compressor;

thereby concentrating refrigeration absorption energy to either said evaporator coil or said second desiccant coil or to both to provide desired supply air and process air output conditions.

18. A desiccant-assisted air conditioning process for conditioning a space, comprising the steps of:

providing a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

providing a supplemental dehumidification/humidification system including a first desiccant coil and a second desiccant coil in said refrigerant flow path, each having desiccant material thereon, said first desiccant coil connected in series between said compressor and said condenser coil, first valve means disposed in the refrigerant flow path for controlling flow of refrigerant between said desiccant coils and said compressor and said evaporator coil, second valve means for controlling flow of refrigerant between said desiccant coils and said condenser coil, and refrigerant metering means disposed in the refrigerant flow path between said second valve means and said condenser coil for reducing the temperature and pressure of refrigerant flowing therethrough;

providing air conveyance means for directing a regeneration air stream through said first desiccant coil and exhausting it, and directing a portion of the supply air discharged by said process fan in a desiccant process air stream through said second desiccant coil and exhausting it back into the supply air which passes into the space to be conditioned; and in a first mode of operation;

discharging hot refrigerant from said compressor into said first desiccant coil and passing the regeneration air stream passing therethrough to cool and condense the refrigerant with the rejected heat of said condensation concurrently drying the desiccant material on the first desiccant coil and the thus cooled and condensed refrigerant passing through said condenser coil to further cool and condense the refrigerant and the thus cooled and condensed refrigerant from the condenser coil passing through said refrigerant metering means to further reduce the temperature and pressure of refrigerant flowing therethrough;

passing the lower temperature and pressure refrigerant through said second desiccant coil such that the desiccant material on the second desiccant coil concurrently absorbs moisture from the desiccant process air stream passing therethrough and heats the refrigerant passing therethrough; and discharging the thus dryer desiccant process air stream back into the supply air and routing the heated refrigerant into said evaporator coil to absorb heat from the process air stream passing therethrough, with the further heated refrigerant being suctioned to said compressor.

19. A desiccant-assisted air conditioning process for conditioning a space, comprising the steps of:

providing a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

providing a supplemental dehumidification/humidification system including a first desiccant coil and a second desiccant coil in said refrigerant flow path, each having desiccant material thereon; first valve means disposed in the refrigerant flow path for controlling flow of refrigerant between said desiccant coils and said compressor and said condenser coil, second valve means disposed in the refrigerant flow path for controlling flow of refrigerant between said desiccant coils and said evaporator coil, first refrigerant metering means disposed in the refrigerant flow path between said second valve means and said evaporator coil, an alternate refrigerant bypass flow path extending between said second valve means and said first refrigerant metering means and said second valve means, and a second refrigerant metering means in said bypass flow path, a first pressure regulator in said refrigerant flow path downstream from said evaporator coil, and a second pressure regulator in said refrigerant flow path downstream from said second desiccant coil;

providing air conveyance means for directing a regeneration air stream through said first desiccant coil and exhausting it, and directing process air drawn by said process fan through said second desiccant coil and through said evaporator coil prior to being discharged as supply air into the space to be conditioned; and in a first mode of operation;

routing condensed refrigerant from said condenser coil into said first desiccant coil and passing the regeneration air stream passing therethrough to further cool and condense the refrigerant with the rejected heat of said condensation concurrently drying the desiccant material on the first desiccant coil, and;

depending upon the control settins of said first and second pressure regulators and said first and second refrigerant metering means, the thus cooled and condensed refrigerant flows from said first desiccant coil either through the first refrigerant metering means to further reduce the temperature and pressure of the refrigerant flowing therethrough, and then passes through said evaporator coil where the lower temperature and pressure refrigerant absorbs heat from the process air stream passing therethrough and the heated refrigerant passes through said first pressure regular and to the suction side of said compressor; or the cooled and condensed refrigerant from said first desiccant coil flows through said second pressure regulator, to further reduce the temperature and pressure of the refrigerant flowing therethrough, and then passes through said second desiccant coil and the desiccant material on the second desiccant coil concurrently absorbs moisture from the process air stream passing therethrough and heats the refrigerant passing therethrough, and the heated refrigerant then being suctioned to said compressor and the dryer process air stream then discharged through said evaporated coil as supply air into the space to be conditioned.

20. A desiccant-assisted heat pump air conditioning and dehumidification/humidification process for conditioning a space, comprising the steps of:

providing a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

providing a supplemental dehumification/humidification system including a first desiccant coil and a second desiccant coil in said refrigerant flow path, each having desiccant material thereon, first valve means disposed in the refrigerant flow path for controlling flow of refrigerant between said desiccant coils and said compressor and said condenser coil, second valve means disposed in the refrigerant flow path for controlling flow of refrigerant between said desiccant coils and said evaporator coil, refrigerant metering means disposed in the refrigerant flow path connected with said second valve means;

providing air conveyance means for directing a regeneration air stream through said first desiccant coil and exhausting it, and directing a portion of the supply air discharged by said process fan in a desiccant process air stream through said second desiccant coil and exhausting it back into the supply air which passes through the evaporator coil and into the space to be conditioned;

providing third valve means in said refrigerant flow path and connected with said compressor for selectively controlling the direction of the flow of refrigerant to and from said compressor; and in a cooling mode of operation:

routing condensed refrigerant from said condenser coil into said first desiccant coil and passing the regeneration air stream passing therethrough to further cool and condense the refrigerant with the rejected heat of said condensation concurrently drying the desiccant material on said first desiccant coil, routing the thus cooled and condensed refrigerant flows through said refrigerant metering means to further reduce the temperature and pressure of the refrigerant flowing therethrough, passing the refrigerant through said second desiccant coil whereby the desiccant material on the second desiccant coil concurrently absorbs moisture from the desiccant process air stream passing therethrough and heats the refrigerant passing therethrough, and passing the heated refrigerant through said evaporator coil to absorb heat from the desiccant process air stream passing therethrough, then suctioning the heated refrigerant to said compressor and discharging it back to the condenser coil, mixing the dryer desiccant process air stream with the supply air and discharging it through said evaporator coil into the space to be conditioned; and in a heating mode of operation:

drawing refrigerant from said condenser via said compressor to increase the temperature and pressure of the refrigerant and discharging it through said evaporator coil to dissipate the refrigerant heat into the process air stream passing therethrough and cool and condense the refrigerant, passing the cooled and condensed refrigerant through said second desiccant coil whereby the desiccant material of the second desiccant coil concurrently humidifies the desiccant process air stream passing therethrough in a desorption process and cools the refrigerant passing therethrough, routing the cooled refrigerant through said refrigerant metering means to reduce the temperature and pressure of the refrigerant flowing therethrough, and passing it through said first desiccant coil whereby the desiccant material of said first desiccant coil concurrently adsorbs heat from the regeneration air stream passing therethrough in a sorption process and heats the refrigerant passing therethrough, routing the heated refrigerant back into the condenser coil, and mixing the moist desiccant process air stream exiting the second desiccant coil back into the supply air stream and passing it through the evaporator coil into the space to be conditioned.

21. The process according to claim 20, comprising the further steps of:

providing a regulating means in said refrigerant flow path parallel with said condenser for regulating refrigerant flow in response to the refrigerant pressure and temperature conditions; and in said heating mode, depending upon the refrigerant pressure and temperature conditions, directing the refrigerant passing through said first desiccant coil back into said condenser; or returning the refrigerant passing through said first desiccant coil back through said evaporator coil via said compressor and said third valve means to bypass entry into said condenser until predetermined refrigerant pressure and temperature conditions are achieved.

22. The process according to claim 20, wherein said second valve means comprises a first and a second refrigerant metering means disposed in series in the refrigerant flow path and connected in parallel with said first and said desiccant coils, and said first and second refrigerant metering means each having a bypass line containing a first and second check valve connected in parallel therewith, respectively, and each of said check valves operating in opposed relation to control the direction of refrigerant flow, said first and second refrigerant metering means being calibrated to only allow flow of refrigerant of respective different temperature and pressure conditions therethrough; and in said cooling mode, routing the cooled and condensed refrigerant passing through said first desiccant coil through said first check valve and then through said second refrigerant metering means and into said second desiccant coil bypassing said first refrigerant metering means, and thereafter continuing the refrigerant flow path as recited in the cooling mode of claim 26; and in said heating mode, routing the heated refrigerant passing through said second desiccant coil through said second check valve and then through said first refrigerant metering means and into said first desiccant coil bypassing said second refrigerant metering means, and thereafter continuing the refrigerant flow path as recited in the heating mode of claim 20.

23. A desiccant-assisted air conditioning and dehumidification/humidification process for conditioning a space, comprising the steps of:

providing a refrigeration circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

providing a supplemental dehumidification/humidification system including a first desiccant coil and a second desiccant coil in said refrigerant flow path, each having desiccant material thereon, first valve means disposed in the refrigerant flow path for controlling flow of refrigerant between said desiccant coils and said compressor and said condenser coil, second valve means disposed in the refrigerant flow path for controlling flow of refrigerant between said desiccant coils and said evaporator coil, and a condenser reheat coil in said refrigerant flow path disposed downstream from said process fan;

providing a first refrigerant bypass flow line connecting said reheat coil with said evaporator coil, and a first refrigerant metering means disposed in said first refrigerant bypass flow line, a second refrigerant bypass flow line adjoined to said first refrigerant bypass flow line between said first refrigerant metering means and extending to said second valve means, and a second refrigerant metering means in said second refrigerant bypass flow line, a first pressure regulator means in said refrigerant flow path downstream from said evaporator coil, and a second pressure regulator means in said refrigerant flow path downstream from said second desiccant coil;

providing air conveyance means for directing a regeneration air stream through said first desiccant coil and exhausting it, and directing process air drawn by said process fan through said evaporator coil, said second desiccant coil, and then through said condenser reheat coil prior to being discharged as supply air into the space to be conditioned; and in a first mode of operation:

routing refrigerant from said condenser coil first through said first desiccant coil and passing the regeneration air stream therethrough to cool and condense the refrigerant with the rejected heat of said condensation concurrently drying the desiccant material of the first desiccant coil, and then routing the condensed refrigerant from said first desiccant coil through said condenser reheat coil to further cool and condense whereby the process air stream passing therethrough and concurrent therewith the process air is heated with the rejected heat of condensation;

the, depending upon the control settings of said first and second pressure regulator means and said first and second refrigerant metering means, routing the thus cooled and condensed refrigerant either though said first refrigerant metering means to further reduce the temperature and pressure of the refrigerant flowing therethrough, and then through said evaporator coil whereby the lower temperature and pressure refrigerant absorbs heat from the process air stream passing therethrough and the heated refrigerant passes through said first pressure regular to the suction side of said compressor; or routing the cooled and condensed refrigerant from said reheat coil through said second refrigerant metering means to further reduce the temperature and pressure of the refrigerant flowing therethrough, and then through said second desiccant coil whereby the desiccant material of the second desiccant coil concurrently absorbs moisture from the process air stream passing therethrough and heats the refrigerant passing therethrough, and the heated refrigerant passes through said second pressure regulator means to the suction side of said compressor.

24. A desiccant-assisted air conditioning and dehumidification/humidification process for conditioning a space, comprising the steps of:

providing a refrigerant circuit including a refrigerant compressor, an evaporator coil, and a condenser coil connected in a refrigerant flow path, a condenser fan that draws outdoor air through the condenser coil and exhausts it back to the outdoors, and a process fan that draws process air through the evaporator coil and discharges it as supply air into a space to be conditioned;

providing a supplemental dehumidification/humidification system including a first desiccant coil and a second desiccant coil in said refrigerant flow path, each having desiccant material thereon, said first desiccant coil connected in series between said compressor and said condenser coil, first valve means disposed in the refrigerant flow path for controlling flow of refrigerant between said desiccant coils and said compressor and said evaporator coil, first pressure regulator means in said refrigerant flow path between said first valve means and the suction side of said compressor, second valve means for controlling flow of refrigerant between said desiccant coils and said condenser coil, a first solenoid valve and a first refrigerant metering means connected in series between said condenser coil and said second valve means, a regeneration condenser coil in said refrigerant flow path disposed between said second valve means and said condenser coil, a first bypass line adjoined between said condenser coil and said first solenoid valve and extending to said evaporator coil, a second solenoid valve and a second refrigerant metering means in said first bypass line, a second pressure regulator means disposed between said evaporator coil and the suction side of said compressor, a second bypass line between said condenser coil and the suction side of said compressor, a fourth solenoid valve, a third refrigerant metering means, a regeneration evaporator coil, and a third pressure regulator means disposed in series in said second bypass line, said regeneration evaporator coil disposed in said regeneration air stream upstream from said regeneration condenser coil;

providing air conveyance means for directing a regeneration air stream through said regeneration evaporator coil, said regeneration condenser coil, said first desiccant coil and then exhausting it, and directing a portion of the supply air discharged by said process fan in a desiccant process air stream through said second desiccant coil and exhausting it back into the supply air which passes into the space to be conditioned; and in a cooling mode of operation, depending upon the demand and/or settings of said solenoid valves, selectively directing the refrigerant back to said compressor, to said evaporator coil, or to said regeneration evaporator coil, or to all simultaneously, or to selected combinations thereof.

25. The process according to claim 24, comprising the further steps of:

in a first flow path, routing superheated refrigerant from said compressor through said first desiccant coil and passing the regeneration air stream through said regeneration evaporator coil and through said regeneration condenser coil whereby the refrigerant is cooled and condensed by said first desiccant coil and the rejected heat of said condensation concurrently dries the desiccant material of said first desiccant coil, passing the cooled and condensed refrigerant through said regeneration condenser coil and through said condenser coil to further cool and condense it, and passing the cooled and condensed refrigerant from the regeneration condenser coil through said first solenoid valve and said first refrigerant metering means to further reduces the temperature and pressure of refrigerant flowing therethrough; and routing the reduced temperature and pressure refrigerant through said second desiccant coil and passing the desiccant process air stream passing therethrough whereby the desiccant material on the second desiccant coil concurrently absorbs moisture from the desiccant process air stream and heats the refrigerant passing therethrough, discharging the thus dryer desiccant process air stream back into the supply air, and routing the heated refrigerant through said first pressure regulator means back to the suction side of the compressor;

in a second flow path, routing refrigerant from said condenser coil through said second solenoid valve and said second refrigerant metering means to reduce the temperature and pressure of refrigerant flowing therethrough, and through said evaporator coil whereby the reduced temperature and pressure refrigerant absorbs heat from the process air stream passing therethrough, and passing the heated refrigerant through said second pressure regulator means to the suction side of said compressor;

in a third flow path, routing refrigerant from said condenser coil through said third solenoid valve and said third refrigerant metering means to reduces the temperature and pressure of refrigerant flowing therethrough, and through said regeneration evaporator coil whereby the reduced temperature and pressure refrigerant absorbs heat from the desiccant process air stream passing therethrough, and passing the heated refrigerant through said third pressure regulator means to the suction side of said compressor; and in a combined flow path, selectively routing refrigerant through any or all of said first second and third flow paths, depending upon the demand.

26. The process according to claim 24, comprising the further step of:

directing said regeneration air stream after passing through said first desiccant coil back through said regeneration evaporator coil, through said regeneration condenser coil, and through said first desiccant coil, in an endless loop.

27. A desiccant-assisted air conditioning and dehumidification/humidification process for conditioning a space, comprising the steps of:

providing a refrigeration circuit including a refrigerant compressor, an evaporator coil, and a condenser reheat coil connected in a refrigerant flow path, a process fan, and a regeneration fan;

providing a first desiccant coil and a second desiccant coil in said refrigerant flow path, each having desiccant material thereon, first valve means disposed in the refrigerant flow path for controlling flow of refrigerant between said desiccant coils and said compressor and second valve means disposed in the refrigerant flow path for controlling flow of refrigerant between said desiccant coils and said evaporator coil and said condenser reheat coil, a refrigerant flow line connecting said reheat coil with said evaporator coil, and a refrigerant metering means disposed in said refrigerant flow line;

said evaporator coil disposed upstream from said first desiccant coil, and said condenser reheat coil disposed downstream from said second desiccant coil;

providing air conveyance means for directing a regeneration air stream drawn by said regeneration fan through said first desiccant coil and exhausting it as desiccant process air, and directing desiccant process air drawn by said process fan through said evaporator coil, said second desiccant coil, and then through said condenser reheat coil prior to being discharged as supply air into the space to be conditioned; and in a cooling mode of operation, discharging refrigerant from said compressor through said first desiccant coil and passing the regeneration air stream passing therethrough to cool and condense the refrigerant whereby the rejected heat of said condensation concurrently dries the desiccant material of said first desiccant coil, passing the condensed refrigerant through said condenser reheat coil and passing the desiccant process air stream passing therethrough to further cool and condense the refrigerant, then routing the thus cooled and condensed refrigerant through said refrigerant metering means to further reduces the temperature and pressure of the refrigerant flowing therethrough, and through said evaporator coil whereby the reduced temperature and pressure refrigerant absorbs heat from the desiccant process air stream passing therethrough, then passing the cooled and condensed refrigerant through said second desiccant coil whereby the desiccant material of the second desiccant coil concurrently absorbs moisture from and dehumidifies the desiccant process air stream passing therethrough and heats the refrigerant passing therethrough, and the heated refrigerant passes to the suction side of said compressor.

28. A desiccant-assisted air conditioning and dehumidification/humidification process for conditioning a space, comprising the steps of:

providing a refrigeration circuit including a refrigerant compressor, an evaporator coil, and a condenser coil connected in a refrigerant flow path, a condenser fan that draws outdoor air through the condenser coil and exhausts it back to the outdoors, a process fan, and a regeneration fan;

providing a first desiccant coil and a second desiccant coil in said refrigerant flow path, each having desiccant material thereon, first valve means disposed in the refrigerant flow path for controlling flow of refrigerant between said desiccant coils, said compressor, and said condenser coil, and second valve means disposed in the refrigerant flow path for controlling flow of refrigerant between said desiccant coils and said evaporator coil, and a refrigerant metering means disposed in said refrigerant flow line between said second valve means and said evaporator coil;

said evaporator coil disposed upstream from said first desiccant coil;

providing air conveyance means for directing a regeneration air stream drawn by said regeneration fan through said first desiccant coil and exhausting it as desiccant process air, and directing desiccant process air drawn by said process fan through said evaporator coil, said second desiccant coil, and discharging it as supply air into the space to be conditioned; and in a cooling mode of operation, discharging hot refrigerant from said compressor through said condenser coil and passing the outdoor air therethrough to cool and condense it, routing cooled and condense refrigerant from said condenser coil through said first desiccant coil and passing the regeneration air stream therethrough to further cool and condense the refrigerant whereby the rejected heat of said condensation concurrently dries the desiccant material of said first desiccant coil, then routing the thus cooled and condensed refrigerant through said refrigerant metering means to further reduce the temperature and pressure of the refrigerant flowing therethrough, and passing it through said evaporator coil to absorb heat from the desiccant process air stream passing therethrough, then routing the cooled and condensed refrigerant through said second desiccant coil whereby the desiccant material of the second desiccant coil concurrently absorbs moisture from and dehumidifies the desiccant process air stream passing therethrough and heats the refrigerant passing therethrough, and the heated refrigerant passes to the suction side of said compressor; and drawing process air through said evaporator coil via said process fan in a bypass process air stream isolated from said desiccant process air stream and mixing it with the desiccant process air stream downstream from said second desiccant coil, and exhausting the combined air into the space to be conditioned.

* * * * *